US009357825B2

(12) United States Patent
Yamasaki

(10) Patent No.: US 9,357,825 B2
(45) Date of Patent: Jun. 7, 2016

(54) NAIL PRINTING DEVICE, PRINT CONTROL METHOD FOR NAIL PRINTING DEVICE, AND COMPUTER READABLE MEDIUM

(71) Applicant: CASIO COMPUTER CO., LTD., Shibuya-ku, Tokyo (JP)

(72) Inventor: Shuichi Yamasaki, Tokyo (JP)

(73) Assignee: CASIO COMPUTER CO., LTD, Tokyo (JP)

( * ) Notice: Subject to any disclaimer, the term of this patent is extended or adjusted under 35 U.S.C. 154(b) by 35 days.

(21) Appl. No.: 14/323,348

(22) Filed: Jul. 3, 2014

(65) Prior Publication Data

US 2015/0007841 A1 Jan. 8, 2015

(30) Foreign Application Priority Data

Jul. 5, 2013 (JP) ..... 2013-141669

(51) Int. Cl.
*A45D 34/04* (2006.01)
*A45D 29/00* (2006.01)

(52) U.S. Cl.
CPC ..... *A45D 29/00* (2013.01); *A45D 34/04* (2013.01); *A45D 2029/005* (2013.01)

(58) Field of Classification Search
CPC ... A45D 2029/005; A45D 29/00; B41J 3/407; B41J 3/4073; B41J 11/008
See application file for complete search history.

(56) References Cited

U.S. PATENT DOCUMENTS 5,931,166 A * 8/1999 Weber ..... A45D 34/04 132/200
6,286,517 B1 * 9/2001 Weber ..... A45D 29/00 132/200
6,336,694 B1 * 1/2002 Ishizaka ..... A45D 29/00 347/105
9,139,021 B2 * 9/2015 Nakajima ..... B41J 3/4073
2011/0315027 A1 * 12/2011 Bitoh ..... A45D 29/00 101/35
2012/0113171 A1 * 5/2012 Murata ..... B41J 3/407 347/2
2012/0274683 A1 * 11/2012 Yamasaki ..... B41J 3/4073 347/2
2012/0287183 A1 * 11/2012 Bitoh ..... A45D 29/00 347/3

FOREIGN PATENT DOCUMENTS

JP 3370345 11/2002

* cited by examiner

*Primary Examiner* — Stephen Meier
*Assistant Examiner* — John P Zimmermann
(74) *Attorney, Agent, or Firm* — Amin, Turocy & Watson LLP; Gregory Turocy

(57) ABSTRACT

A nail printing device recognizes, as a first nail contour, a nail contour from a first nail image obtained by photographing a nail of a specific finger/toe, displays the first nail contour on the basis of data of the first nail contour stored in a storage section, and performs an adjustment of the first nail contour on the basis of an adjustment portion specified to the first nail contour and obtains an adjusted nail contour. After that the device recognizes, as a second nail contour, a nail contour from a second nail image obtained by photographing the nail of the specific finger/toe, reflects the adjustment performed to the first nail contour, in the second nail contour, obtains an adjusted recognized nail contour, and controls a print head to perform printing in a region of the adjusted recognized nail contour.

17 Claims, 12 Drawing Sheets

523

| MODE NUMBER | MODE CONTENT |
|---|---|
| MODE 1 | AUTOMATIC TRACK JUDGMENT MODE |
| MODE 2 | AUTOMATIC POINT MODE |
| MODE 3 | MANUAL TRACK MODE A |
| MODE 4 | MANUAL TRACK MODE B |

NAIL PRINTING DEVICE, PRINT CONTROL METHOD FOR NAIL PRINTING DEVICE, AND COMPUTER READABLE MEDIUM

CROSS-REFERENCE TO RELATED APPLICATIONS

This application is based upon and claims the benefit of priority from the prior Japanese Patent Application No. 2013-141669 filed on Jul. 5, 2013, the entire contents of which are incorporated herein by reference.

BACKGROUND OF THE INVENTION

1. Field of the Invention

The present invention relates to a nail printing device, a print control method for the nail printing device, and a computer readable medium.

2. Description of the Related Art

Heretofore, there have been known nail printing devices that print favorite nail designs on human fingernails.

Among such nail printing devices, there has been a nail printing device that automatically recognizes nail contours (nail shapes) to set regions in which printing is to be performed.

However, for example, in the case that nail cuticles have not been cared, the cuticle portions are difficult to be distinguishably recognized from nail portions in automatic recognition of nail contours executed in the nail printing device, even when a user does not want to execute printing on the cuticle portions.

Moreover, in the case that a part of each nail has become discolored, and/or in the case that a borderline between each nail and skin is uneven, sometimes each nail region cannot be extracted successfully.

In such case, it is preferable that the extracted region can be adjusted appropriately after automatic recognition.

In regard to this point, for example, Japanese Patent No. 3370345 discloses the technique that enables a user to move a setting position of a printing mask that sets a shape and position of a print target nail region, and/or to change the shape of the printing mask, by operating a joystick, after a nail on which printing is to be performed is set in a device.

However, it takes time to manually extract/adjust the nail regions.

Moreover, a user who is a layman cannot always trace the borderline of the nail with accuracy even when manually adjusting the position/shape of the printing mask similarly to the method described in Japanese Patent No. 3370345.

Furthermore, according to the method described in Japanese Patent No. 3370345, the nail (finger) on which printing is to be performed is still set in the device when the nail region etc. is manually adjusted. In this adjusting period, a user must try not to move his/her finger inserted in the nail printing device. This would impose a heavy burden on a user.

In the case that a dominant-hand-side nail is subjected to nail printing, the adjustment work needs to be executed by a non-dominant hand, and properly performing such adjustment work has therefore been difficult.

SUMMARY OF THE INVENTION

The present invention has advantages that a nail printing device capable of easily adjusting a recognition result of a nail contour so that it becomes a user-intended contour; a print control method for the nail printing device; and a computer readable medium can be provided.

According to the first aspect of the present invention, there is provided a nail printing device including: a first nail contour recognizing section which recognizes, as a first nail contour, a nail contour from a first nail image obtained by photographing a nail of a specific finger/toe; a display section which displays the first nail contour on the basis of data of the first nail contour stored in a storage section; a recognition result adjusting section which performs an adjustment of the first nail contour, displayed in the display section, on the basis of an adjustment portion specified to the first nail contour and obtains an adjusted nail contour; a second nail contour recognizing section which recognizes, as a second nail contour, a nail contour from a second nail image obtained by photographing the nail of the specific finger/toe after the recognition result adjusting section performs the adjustment of the first nail contour, and reflects the adjustment performed to the first nail contour, in the second nail contour, and obtains an adjusted recognized nail contour; and a print control section to control a print head to perform printing in a region of the adjusted recognized nail contour.

According to the second aspect of the present invention, there is provided a print control method for a nail printing device, the method including the steps of: recognizing, as a first nail contour, a nail contour from a first nail image obtained by photographing a nail of a specific finger/toe; displaying the first nail contour in a display section on the basis of data of the first nail contour stored in a storage section; obtaining an adjusted nail contour by performing an adjustment of the first nail contour on the basis of an adjustment portion specified to the first nail contour displayed in the display section; recognizing, as a second nail contour, a nail contour from a second nail image obtained by photographing the nail of the specific finger/toe after the adjustment of the first nail contour is performed; obtaining an adjusted recognized nail contour by reflecting the adjustment performed to the first nail contour in the second nail contour; and controlling a print head to perform printing in a region of the adjusted recognized nail contour.

According to the third aspect of the present invention, there is provided a computer readable medium storing a print control program for causing a computer of a nail printing device to execute the steps of: recognizing, as a first nail contour, a nail contour from a first nail image obtained by photographing a nail of a specific finger/toe; displaying the first nail contour in a display section on the basis of data of the first nail contour stored in a storage section; obtaining an adjusted nail contour by performing an adjustment of the first nail contour on the basis of an adjustment portion specified to the first nail contour displayed in the display section; recognizing, as a second nail contour, a nail contour from a second nail image obtained by photographing the nail of the specific finger/toe after the adjustment of the first nail contour is performed; obtaining an adjusted recognized nail contour by reflecting the adjustment performed to the first nail contour in the second nail contour; and controlling a print head to perform printing in a region of the adjusted recognized nail contour.

BRIEF DESCRIPTION OF THE SEVERAL VIEWS OF THE DRAWINGS

The above and further objects, features and advantages of the present invention will be made clearer by the following detailed description and the attached drawings, in which.

DESCRIPTION OF THE PREFERRED EMBODIMENT

An embodiment of a nail printing device according to the present invention will be described in detail with reference to the attached drawings.

Although various limitations that are technically preferable for implementing the present invention are added to the embodiment hereinafter described, the scope of the present invention is not limited to the following embodiment and illustrated examples.

In the following embodiment, an example where each fingernail of a hand is a print target and the nail printing device performs printing to the fingernail will be described. In this regard, however, a drawing object of the present invention is not limited to a fingernail of a hand. Such printing object may be each of toenails.

Figure 1:
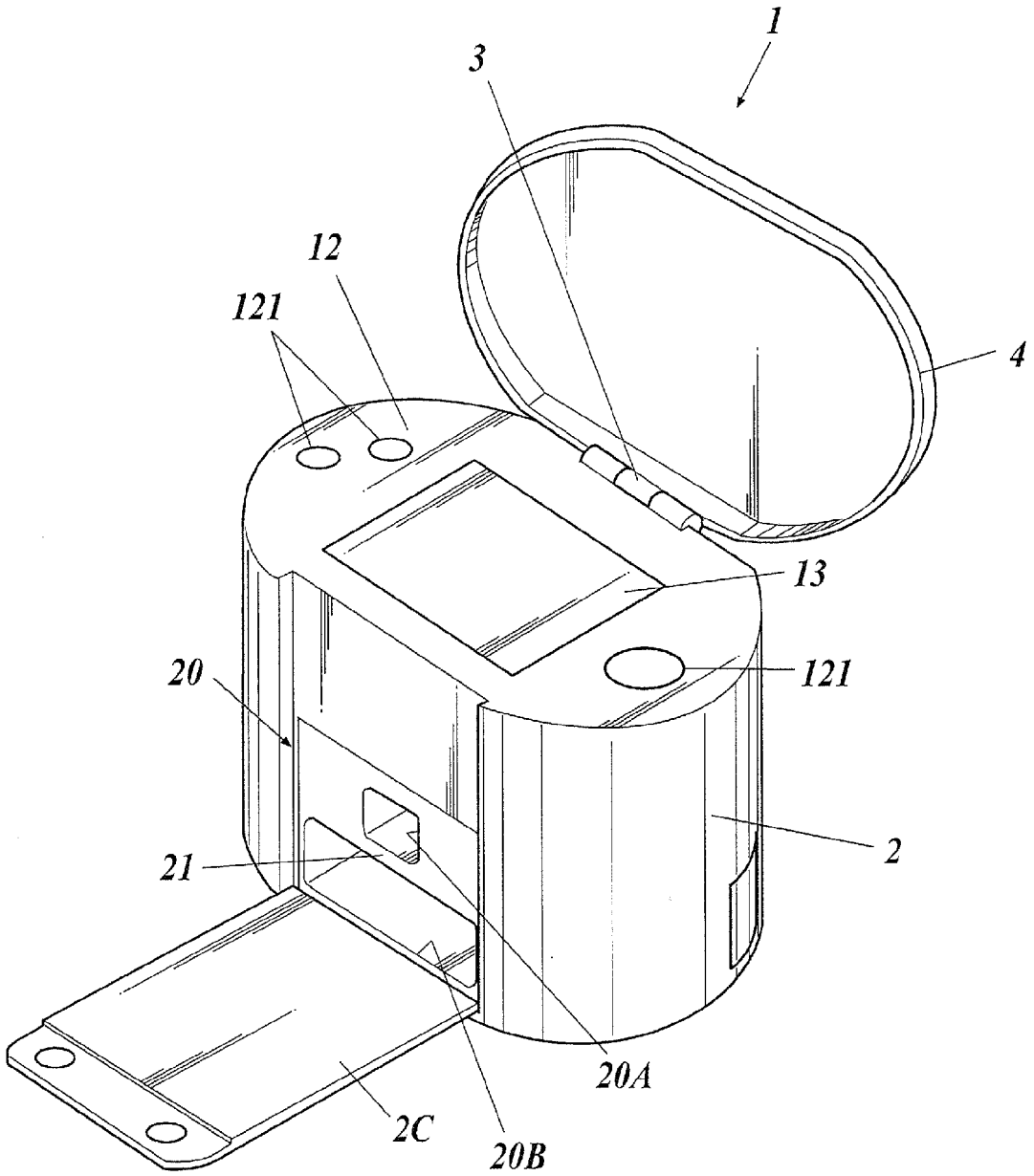
FIG. 1 is a perspective view conceptually illustrating a nail printing device according to this embodiment, a lid body of the nail printing device being opened.

FIG. 1 is a perspective view illustrating an appearance of the nail printing device according to this embodiment.

As illustrated in FIG. 1, the nail printing device 1 is equipped with a case main body 2 and a lid body 4.

The lid body 4 is rotatably connected with the case main body 2 through a hinge 3 provided at a rear end of an upper surface (top board) of the case main body 2. The lid body 4 can rotate with the hinge as a supporting point so that it changes from the state of being laid on the top board of the case main body 2 to the state of standing with respect to the top board of the case main body 2 (see FIG. 1) and vice versa.

The case main body 2 has an approximately elliptical shape in planar view seen from above.

On the front side of the case main body 2, an opening/closing plate 2C is provided so that it can be raised and laid down.

The opening/closing plate 2C is connected with the case main body 2 though a hinge (not illustrated) provided at a lower end of a front surface of the case main body 2. The opening/closing plate 2C is provided in order to open and close the front surface of the case main body 2.

Incidentally, the shapes/configurations of the case main body 2 and the lid body 4 are not limited to the examples illustrated herein.

In the upper surface (top board) of the case main body 2, an operation section 12 is provided.

The operation section 12 enables a user to perform various kinds of inputs.

In the operation section 12, for example, there are disposed: a power switch button for turning on a power of the nail printing device 1; a stop switch button for stopping the operation of the nail printing device 1; a design selection button for selecting a design image(s) to be printed on a nail(s) T; a printing start button for instructing a print start; and an operation button 121 for performing other various inputs.

In the embodiment, the operation section 12 includes a touch panel input section 122 (see FIG. 3) provided in an after-described display section 13.

The display section 13 is provided in an approximately center part of the upper surface (top board) of the case main body 2.

The display section 13 is composed of, for example, a Liquid Crystal Display (LCD), an organic electroluminescence display, or other plat displays, etc.

The display section 13 of the embodiment displays, for example, a nail image(s) (namely, an image of a print target finger U1 including an image of the nail T) which is the image of the nail T of the print target finger U1; a nail contour adjustment screen for adjusting a primary automatically-recognized nail contour L1 which is recognized in an after-described primary automatic nail contour recognition; a design selection screen for selecting the design image to be printed on the nail T; a thumbnail image(s) for confirming the design; an instruction screen which displays various instructions; an announcement screen; a warning screen, and so on, as necessary.

The touch panel input section 122 (see FIG. 3) is integrally configured with the surface of the display section 13 of the embodiment.

The touch panel input section 122 is configured to enable various inputs by touch operations, namely, touching the surface of the display section 13 with a fingertip, a stylus pen 123 (see FIG. 5A and the like; hereinafter simply referred to as "pen 123"), or an input member such as a rod-like writing pen/pencil having a pointed top, and thereby operates as the operation section 12.

Figure 5A:
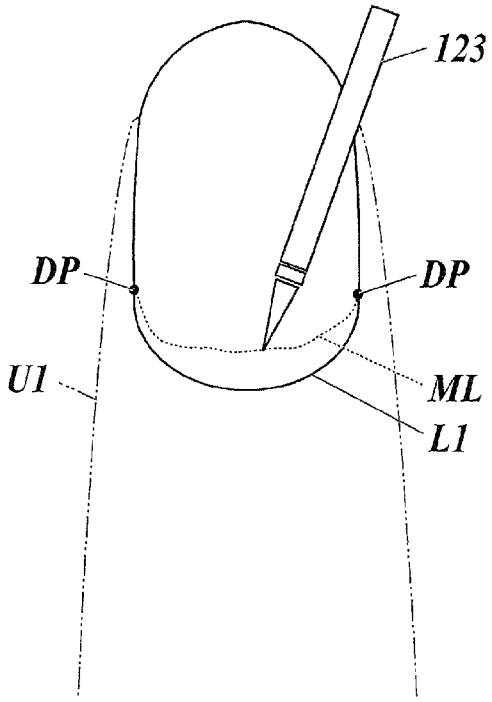
FIGS. 5A and 5B are diagrams for explaining an automatic track judgment mode.

Incidentally, the embodiment describes examples where touch operations are performed by using the pen 123 in FIG. 5A etc.

Figure 2:
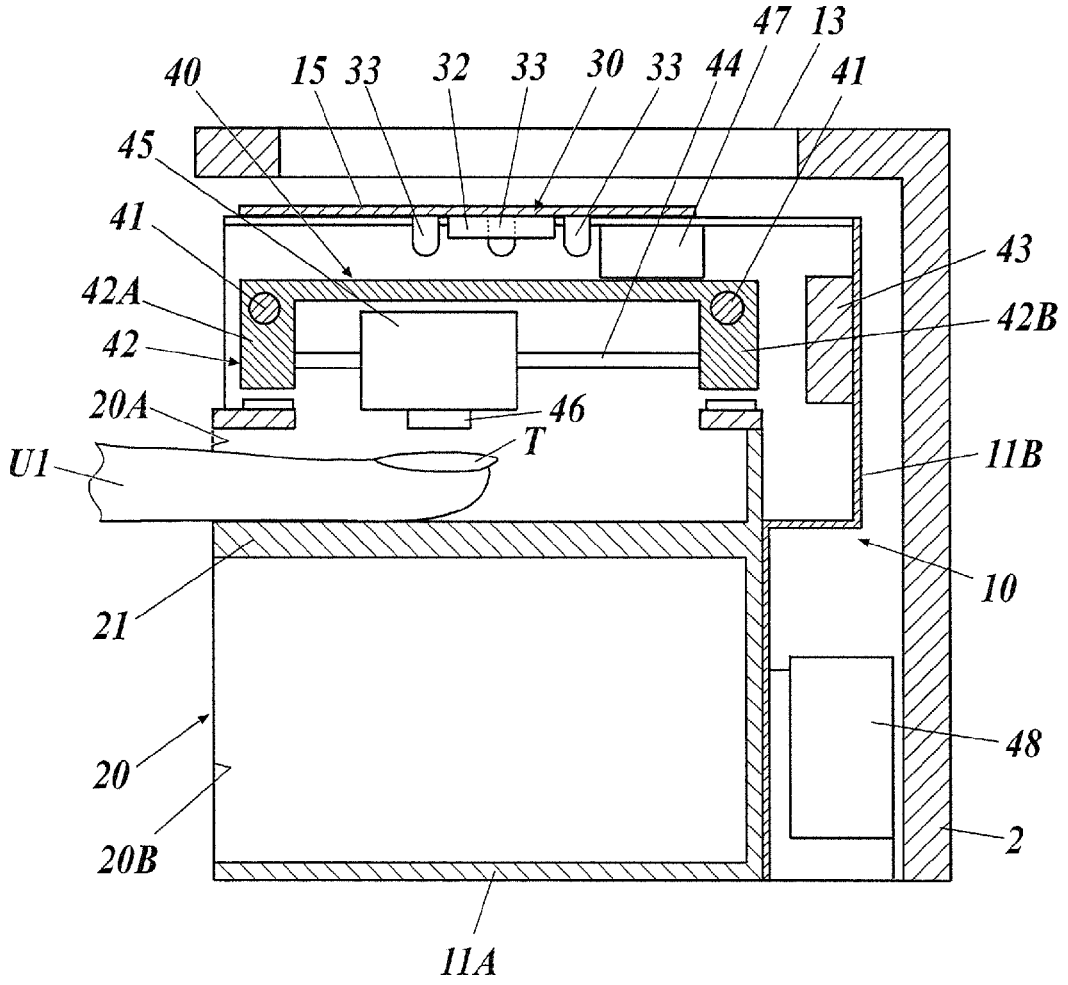
FIG. 2 is a cross sectional view of a main part of the nail printing device illustrated in FIG. 1.

FIG. 2 is a sectional view of a main part of the nail printing device 1.

As illustrated in FIG. 2, the case main body 2 houses a device main body 10 of the nail printing device 1.

The device main body 10 is formed in a box shape approximately, and includes a lower machine casing 11A placed in a lower portion of the inside of the case main body 2, and an upper machine casing 11B placed above the lower machine casing 11A and in an upper portion of the inside of the case main body 2.

In these lower machine casing 11A and upper machine casing 11B, there are provided a print target finger fixing section 20, a photographing section 30, a printing section 40, a control device 50 (see FIG. 3), and so on.

The print target finger fixing section 20 is provided in the lower machine casing 11A.

Concretely, the lower machine casing 11A includes a print target finger/toe insertion section 20A and a non-print target finger/toe insertion section 20B, which constitute the print target finger fixing section 20 together. The print target finger/toe insertion section 20A and the non-print target finger/toe insertion section 20B are separated from each other with a division wall 21.

The print target finger/toe insertion section 20A is a finger/toe insertion section into which a finger (herein after referred to as "print target finger U1") corresponding to the nail T to be subjected to printing is inserted.

The bottom surface (the upper surface of the division wall 21 in the embodiment) of the print target finger/toe insertion section 20A functions as a finger placement section (print target finger placement section) on which the print target finger U1 is placed.

Photographing, printing, etc. of the print target finger U1 are performed while the print target finger U1 is placed on a print target finger placement surface (the upper surface of the division wall 21) of the print target finger/toe insertion section 20A as the finger placement section.

Incidentally, the embodiment describes an example where the print target fingers U1 are inserted into the print target finger/toe insertion section 20A one by one and then printing etc. is performed to each of the nails T.

Although the shape, size, etc. of the print target finger/toe insertion section 20A are not especially limited, the print target finger/toe insertion section 20A is configured to have a certain size so that an adult user does not feel tight when inserting his/her thumb etc. into the print target finger/toe insertion section 20A, in order to deal with various fingers.

The non-print target finger/toe insertion section 20B is a finger/toe insertion section into which fingers (not illustrated; hereinafter "non-print target fingers") other than the print target finger are inserted.

In the embodiment, the print target finger U1 is fixed in a stable condition by inserting the print target finger U1 into the print target finger/toe insertion section 20A, inserting the non-print target fingers into the non-print target finger/toe insertion section 20B, and sandwiching the division wall 21 by the print target finger U1 and the non-print target fingers.

For example, in the case that the print target finger U1 is a thumb, a user inserts the thumb (the print target finger U1) into the print target finger/toe insertion section 20A, and inserts the four fingers (index finger, middle finger, medicinal finger and little finger) other than the thumb into the non-print target finger/toe insertion section 20B as the non-print target fingers. In this case, the print target finger U1 is fixed when the print target finger U1 and non-print target fingers of the user hold the division wall 21 therebetween.

Additionally, the division wall 21 preferably has a cross section, in a finger insertion direction, of a shape naturally fitting a base of the print target finger U1 or each non-print target finger, such as a round shape, an elliptical shape and a polygon shape, in the finger-insertion-side end portion thereof, in order to minimize a burden on a base of each finger when the print target finger U1 and the non-print target fingers strongly hold the division wall 21 therebetween.

As illustrated in FIG. 2, the photographing section 30 is disposed in the upper machine casing 11B.

Concretely, a basal plate 15 is disposed on the upper machine casing 11B, and a camera 32 as the photographing device is placed at the center of the lower surface of the basal plate 15.

The camera 32 preferably has a resolution of approximately two million pixels or more.

The camera 32 takes a photograph of the nail T of the print target finger U1, which is being inserted into the print target finger/toe insertion section 20A, to obtain a nail image (i.e. the image of the print target finger U1 including the image of the nail T) which is an image of the nail T of the print target finger U1.

On the basal plate 15, also illuminating lumps 33 such as white LEDs are disposed so as to surround the camera 32. The illuminating lumps 33 illuminate the nail T of the print target finger U1 when the camera 32 performs photographing. The photographing section 30 is composed of the camera 32 and the illuminating lumps 33.

In the embodiment, the camera 32 as the photographing device performs photographing twice, namely, performs primary photographing and secondary photographing. Then a later-described nail contour recognizing section 512 automatically recognizes the contour (shape) of the nail T on the basis of the nail image (primary nail image) obtained by primary photographing and the nail image (secondary nail image) obtained by secondary photographing.

The image data of the nail image (primary nail image) obtained by primary photographing is stored in a later-described primary nail image memory 524 of a storage section 52 (see FIG. 3).

The image data of the nail image (secondary nail image) obtained by secondary photographing is stored in a later-described secondary nail image memory 528 of the storage section 52 (see FIG. 3).

The photographing section 30 is connected to a later-described photographing control section 511 of the control device 50 (see FIG. 3), and controlled by the photographing control section 511.

The printing section 40 is mainly provided in the upper machine casing 11B.

Concretely, in the upper machine casing 11B, two guide rods 41 extend, parallel to each other, between both side plates of the upper machine basing 11B, the ends of the guide rods 41 being fixed to the both side plates, respectively. A main carriage 42 is slidably attached to the guide rods 41.

Between a front wall 42A and a rear wall 42B of the main carriage 42, two guide rods 44 (only one near-side rod is illustrated in FIG. 2) extend parallel to each other.

A sub carriage 45 is slidably attached to the guide rods 44. On the lower surface of the sub carriage 45, a print head 46 is mounted.

The print head 46 of the embodiment is an ink jet type print head which produces micro-droplets of ink and directly sprays them on a printing object surface of a printing target to perform printing.

Incidentally, the recording type of the print head 46 is not limited to the ink jet type.

In the embodiment, the printing section 40 is provided with the print head 46 adaptable for inks of, for example, yellow (Y), magenta (M) and cyan (C).

The print head 46 is provided with a nozzle array composed of a plurality of nozzles which eject inks of the respective colors.

The print head 46 included in the printing section 40 is not limited to the print head which ejects the inks of these three colors. The printing section 40 may include a print head which also ejects an ink of another color(s).

The print head 46 prints the image (nail design) on the surface of the nail T of the print target finger U1.

The print head 46 performs printing to the nail T of the print target finger U1 on the basis of nail information detected by the later-described nail contour recognizing section 512.

On the lower machine casing 11A, ink cartridges 48 that supply the inks to the print head 36 is disposed.

The ink cartridges 48 are connected to the print head 46, through not-illustrated ink supply tubes, to supply the inks to the print head 46 as necessary.

Alternatively, a configuration where the print head 46 itself mounts the ink cartridges may be adopted.

The main carriage 42 is connected to a motor 43 through a power transmitting section (not illustrated), and is configured to move in a right-left direction (a width direction of the nail printing device 1) in the nail printing device 1 along the guide rods 41 by forward/reverse rotations of the motor 43.

The sub carriage 45 is connected to a motor 47 through a power transmitting section (not illustrated), and is configured to move in a front-back direction (a right-left direction in FIG. 2) in the nail printing device 1 along the guide rods 44 by forward/reverse rotations of the motor 47.

The printing section 40 is composed of these guide rods 41, main carriage 42, motor 43, guide rods 44, sub carriage 45, print head 46, motor 47, ink cartridges 48, etc.

The motor 43, print head 46 and motor 47 of the printing section 40 are connected to a later-described print control section 514 (see FIG. 3) of the control device 50, and controlled by the print control section 514.

The control device 50 is placed, for example, on the basal plate 15 disposed on the upper machine casing 11B.

Figures 3, 4:
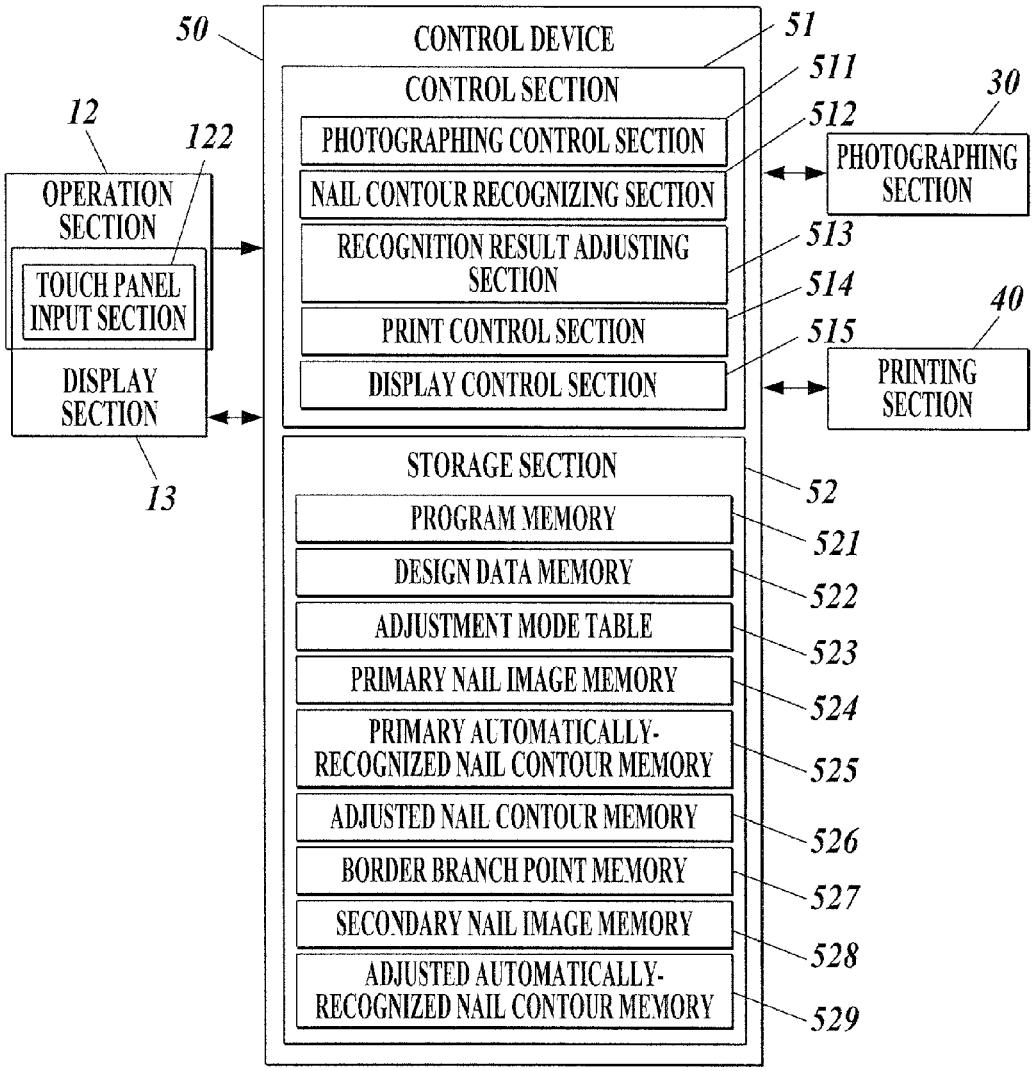
FIG. 3 is a main part block diagram illustrating a control configuration of the nail printing device according to the embodiment.
FIG. 4 is a diagram illustrating an example of an adjustment mode table in FIG. 3.

FIG. 3 is a main-part block diagram illustrating a control configuration of the control device 50 according to the embodiment.

As illustrated in FIG. 3, the control device 50 is a computer equipped with: a control section 51 composed of a not-illustrated Central Processing Unit (CPU) etc.; and the storage section 52 composed of a Read Only Memory (ROM), a Random Access Memory (RAM), etc.

The storage section 52 includes a program memory 521, a design data memory 522, an adjustment mode table 523, the primary nail image memory 524, a primary automatically-recognized nail contour memory 525, an adjusted nail contour memory 526, a border branch point memory 527, the secondary nail image memory 528 and an adjusted automatically-recognized nail contour memory 529.

The program memory 521 stores various programs for operating the nail printing device 1.

In the embodiment, the program memory 521 stores various programs, for example, a nail contour recognition program for automatically recognizing the nail contour of the nail T, a nail contour adjustment program for performing nail contour adjusting process to adjust the automatically-recognized nail contour, an adjusted automatic nail contour recognition program for performing an adjusted automatic nail contour recognizing process to obtain an adjusted automatically-recognized nail contour in which the adjusted nail contour has been reflected, a print program for performing printing process, and so on. The printing device 50 executes these programs as necessary to control each section of the nail printing device 1.

The design data memory 522 stores image data of the nail designs to be printed on the nail T.

The image data of the nail designs stored in the design data memory 522 are, for example, rectangular data. Each piece of the image data of the nail designs has a larger size than a general size of the nail T in order to deal with various sizes of the nails T.

The adjustment mode table 523 stores mode numbers of nail contour adjustment modes (hereinafter simply referred to as "adjustment modes"), and a content of each of the adjustment modes (i.e. a content of a process in each of the adjustment modes) so that the mode numbers correspond to the adjustment modes, respectively.

FIG. 4 is a diagram illustrating an example of the adjustment mode table 523.

In FIG. 4, each of the adjustment modes (nail contour adjustment modes) is simply referred to as "Mode".

As illustrated in FIG. 4, in the embodiment, there are prepared four kinds of adjustment modes including: an automatic track judgment mode (Mode 1); an automatic point mode (Mode 2); a manual track mode A (Mode 3); a manual track mode B (Mode 4).

When a user selects/inputs any one of the mode numbers in the operation section 12, the content corresponding to the selected mode number is read out from the adjustment mode table 523. Then a later-described recognition result adjusting section 513 performs the nail contour adjusting process according to the read-out content.

The adjustment modes will be described in detail later.

The primary nail image memory 524 stores the image data of the nail image (primary nail image) of the nail T of the print target finger U1 of a user, the image data being obtained by the photographing section 30 in the primary photographing.

The secondary nail image memory 528 stores the image data of the nail image (secondary nail image) of the nail T of the print target finger U1 of a user, the image data being obtained by the photographing section 30 in the secondary photographing.

The primary automatically-recognized nail contour memory 525 stores, when the nail contour recognizing section 512 automatically recognizes the contour (shape) of the nail T on the basis of the primary nail image (the primary automatic nail contour recognition), the primary automatically-recognized nail contour L1 (see FIG. 5A, etc.) which is the result of the above automatic recognition.

The adjusted automatically-recognized nail contour memory 529 stores, when the nail contour recognizing section 512 reflects a later-described adjusted nail contour RL (see FIG. 5B, etc.) in the secondary nail image and automatically recognizes the contour (shape) of the nail T (secondary automatic nail contour recognition), an adjusted automatically-recognized nail contour (not illustrated) which is the result of the above automatic recognition.

The contour (shape) of the nail T is a border between a print target region and a region other than the print target region, for example, a border between the nail T and a fleshy part of the finger.

Each of the primary automatically-recognized nail contour L1 and the adjusted automatically-recognized nail contour is obtained, for example, by representing positions (border line composed of an assembly of points) of a plurality of points constituting the automatically-recognized contour of the nail T with x-y coordinates or the like.

The adjusted nail contour memory 526 stores the adjusted nail contour RL after adjustment in the case that the nail contour adjusting process to adjust the primary automatically-recognized nail contour L1 is performed depending on the adjustment mode.

The border branch point memory 527 stores border branch points DP.

The border branch points DP are points existing on the primary automatically-recognized nail contour L1, and are starting and end points of a portion to be adjusted, among the points constituting the adjusted nail contour RL. In other words, the border branch points DP are points where the nail contour is divided into the primary automatically-recognized nail contour L1 and the adjusted nail contour RL when adjustment is performed to the primary automatically-recognized nail contour L1 that is the result of the automatic recognition (primary automatic nail contour recognition) of the contour (shape) of the nail T based on the primary nail image performed by the nail contour recognizing section 512.

The border branch points DP exist as a set of: the point (the starting point of the portion to be adjusted) where the primary automatically-recognized nail contour L1 and the adjusted nail contour RL are separated from each other; and the point (the end point of the portion to be adjusted) where these two contours join together.

Incidentally, FIG. 5 etc. illustrate the example where the number of the border branch points DP are two, namely, the number of sets of the border branch points DP is one (1). However, the number of the border branch points DP is not limited to two and the number of sets of the border branch points DP is not limited to one (1).

In the case that there are a plurality of portions to be adjusted on the contour of the nail T, each of the portions includes the starting and end points. In this case, there are a plurality of sets of the border branch points DP, namely, four or more border branch points DP.

The border branch point memory 527 stores x-y coordinates or the like representing the positions of the border branch points DP.

Additionally, in the case that four or more border branch points DP exist (i.e. in the case that two or more sets of the starting and end points of the adjusted portions exist), the starting and end points of each adjusted portion are correlated to each other as one (1) set and stored in the border branch point memory 527.

The control section 51 includes, as viewed from the perspective of functionality, functional sections such as the photographing control section 511, nail contour recognizing section 512, the recognition result adjusting section 513, the print control section 514, a display control section 515, etc.

The functions as these photographing control section 511, nail contour recognizing section 512, recognition result adjusting section 513, print control section 514 and display control section 515 are implemented by the CPU of the control section 51 in cooperation with the programs stored in the ROM etc. of the storage section 52.

The functional sections contained in the control section 51 are not limited to those adopted above.

The photographing control section 511 controls the photographing section 30 so that the camera 32 takes the photograph of the print target finger U1 of a user to obtain the nail image (i.e. the image of the print target finger U1 including the image of the nail T).

In the embodiment, after a printing process starting instruction is input from the operation section 12, the photographing control section 511 causes the photographing section 30 to perform first photographing (primary photographing) at the timing of setting of the print target finger U1 of a user in the print target finger/toe insertion section 20A.

Then, after the nail contour adjusting process is performed in the state that the print target finger U1 of a user is drawn out of the print target finger/toe insertion section 20A, the photographing control section 511 causes the photographing section 30 to perform second photographing (secondary photographing) at the timing of re-setting of the print target finger U1 of the user in the print target finger/toe insertion section 20A.

The primary photographing and the secondary photographing are preferably executed in a situation where photographing conditions such as illumination by the illuminating lumps 33 are same as each other as much as possible.

The image data of the nail images (primary nail images) obtained by the primary photographing are stored in the primary nail image memory 524, and the image data of the nail images (secondary nail images) obtained by the secondary photographing are stored in the secondary nail image memory 528.

The nail contour recognizing section 512 automatically recognizes the contour (hereinafter referred to as "nail contour" or "nail shape") of the nail T of the print target finger U1 on the basis of the nail image obtained by the camera 32 as the photographing device.

In the embodiment, the nail contour recognizing section 512 functions as a first nail contour recognizing section which performs the primary automatic nail contour recognition (first nail contour automatic recognition) on the basis of the nail image (primary nail image) obtained by the primary photographing to obtain the primary automatically-recognized nail contour L1.

Concretely, the nail contour recognizing section 512 detects the nail contour (nail shape) from the nail image (primary nail image) of the nail T of the print target finger U1, the nail image being obtained by the camera 32, and obtains this nail contour as positional information represented by x-y coordinates or the like.

More specifically, the nail contour recognizing section 512 automatically recognizes the nail contour (nail shape) on the basis of the color difference between the nail T and another portion of the finger from the nail image of the nail T of the print target finger U1 obtained by the camera 32.

In this case, the storage section 52 previously stores a detection threshold for executing the automatic recognition of the nail contour, and the nail contour recognizing section 512 obtains the primary automatically-recognized nail contour L1, for example, by detecting a border between points exceeding a predetermined detection threshold and points not exceeding the predetermined detection threshold, and executing smoothing process to smooth the border.

Incidentally, the method for detecting the nail contour (nail shape) by the nail contour recognizing section 512 is not limited to the example illustrated herein, and various methods for detecting the contour can be applied.

The primary automatically-recognized nail contour L1, which is the result of the automatic recognition by the nail contour recognition section 512, is stored in the primary automatically-recognized nail contour memory 525 of the storage section 52.

Additionally, the number of the border line to be detected by the nail contour recognizing section 512 is not limited to one (1), and a plurality of border lines (candidate nail contours) can be detected by changing the detection threshold from a previously-set value to a certain value. For example, a border between a finger and a root of the nail T, a border between a portion covered with a cuticle of the nail T and a portion without the cuticle, and so on can be detected.

In this case, for example, the storage section 52 previously stores a general nail contour by default, and the border line nearest the general nail contour is set as the primary automatically-recognized nail contour L1.

In the embodiment, when the nail contour recognizing section 512 detects another border line(s) (e.g. border lines L2, L3 illustrated in FIG. 5B), as the candidate nail contours, in addition to the primary automatically-recognized nail contour L1, the border line set as the primary automatically-recognized nail contour L1 and the another border line(s) (e.g. border lines L2, L3 illustrated in FIG. 5B) detected as the candidate nail contours are stored together in the primary automatically-recognized nail contour memory 525.

Thus, the plurality of border lines may be recognized in either cases of the primary automatic nail contour recognition and of the secondary automatic nail contour recognition.

The nail contour recognizing section 512 also functions as a second nail contour recognizing section which performs the secondary automatic nail contour recognition (second nail contour automatic recognition) to automatically re-recognize the nail contour (nail shape) on the basis of the nail image (secondary nail image) obtained by the secondary photographing, and sets the nail contour obtained by reflecting the contour (adjusted nail contour RL) adjusted by the later-described recognition result adjusting section 513 in the result of the secondary automatic nail contour recognition, as the adjusted automatically-recognized nail contour.

In the embodiment, there are prepared three methods (Method 1, Method 2 and Method 3) as adjusted automatic nail contour recognizing processes for obtaining the adjusted automatically-recognized nail contour.

A user selects any one of the three methods that have been prepared.

The nail contour recognizing section 512 as the second nail contour recognizing section executes the adjusted automatic nail contour recognition according to the selected method.

The adjusted automatically-recognized nail contour, which is the result of the automatic recognition by the nail contour recognizing section 512, is stored in the adjusted automatically-recognized nail contour memory 529 of the storage section 52.

Each of three methods of adjusted automatic nail contour recognizing process for obtaining the adjusted automatically-recognized nail contour will be described concretely.

<Method 1>

The adjusted automatic nail contour recognizing process according to Method 1 is an adjusted automatic nail contour recognizing process to be executed in the case that Mode 1 or Mode 2 is selected as the adjustment mode in the nail contour adjusting process by the recognition result adjusting section 513.

In the adjusted automatic nail contour recognizing process according to Method 1, first, the nail contour recognizing section 512 automatically recognizes the nail contour (nail shape) based on the secondary nail image (secondary automatic nail contour recognition).

Also in this secondary automatic nail contour recognition, the plurality of candidate nail contours can be detected similarly to the case of the primary automatic nail contour recognition.

Incidentally, in the secondary automatic nail contour recognition, the automatic re-recognition is performed only to a region corresponding to the portion (i.e. adjusted nail contour RL) that has been adjusted by the recognition result adjusting section 513 in the nail contour adjusting process, the region being between the pair of border branch points DP.

In the case that a plurality of adjusted portions (adjusted nail contours R1) exist, the automatic recognition is performed to all of the adjusted portions.

The nail contour recognizing section 512 then reads out the primary automatically-recognized nail contour L1, the adjusted nail contour(s) RL and the border branch points DP from the storage section 52, and performs superposition (i.e., e.g., matching process etc.) of the primary automatically-recognized nail contour L1, and the secondary automatically-recognized nail contour which is the result of the secondary automatic nail contour recognition.

Then, the nail contour recognizing section 512 detects points (border branch points on the secondary automatically-recognized nail contour) on the secondary automatically-recognized nail contour which correspond to the border branch points DP on the primary automatically-recognized nail contour L1.

When the border branch points on the secondary automatically-recognized nail contour are detected, with respect to the border portion whose starting and end points are the border branch points on the secondary automatically-recognized nail contour, a border corresponding to the adjusted nail contour RL is detected among the candidate nail contours detected by the secondary automatic nail contour recognition.

After that, border adjustment is performed by reflecting the detected border in the secondary automatically-recognized nail contour. Moreover, a smoothing process is performed to smoothly connect the adjusted border portion and the unadjusted border portion (i.e. a portion left as the primary automatically-recognized nail contour L1) to each other to produce the adjusted automatically-recognized nail shape.

<Method 2>

The adjusted automatic nail contour recognizing process according to Method 2 is an adjusted automatic nail contour recognizing process to be executed in the case that Mode 1 or Mode 2 is selected as the adjustment mode in the nail contour adjusting process by the recognition result adjusting section 513, similarly to the case of the adjusted automatic nail contour recognizing process according to Method 1.

In the adjusted automatic nail contour recognizing process according to Method 2, first, the nail contour recognizing section 512 obtains the secondary nail image, and reads out the adjusted nail contour RL and the primary automatically-recognized nail contour L1 from the storage section 52.

Then the nail contour recognizing section 512 adjusts the detection threshold or the like so that the border becomes nearest the adjusted nail contour RL, and automatically recognizes the nail contour from the secondary nail image (secondary automatic nail contour recognition).

The specific case where the nail contour recognizing section 512 automatically recognizes the nail contour will be considered. For example, in the case that the detection threshold is composed of RGB densities, if a value(s) of red (R) component(s) of the detection threshold is set to be high, the nail contour recognizing section 512 recognizes a border between a finger and a nail root part as the nail contour. If the value(s) of red (R) component(s) of the detection threshold is set to be low, the nail contour recognizing section 512 recognizes a border between a nail portion covered with a cuticle and a nail portion without a cuticle as the nail contour. Thus, the nail contour recognizing section 512 is capable of detecting the plurality of border lines (e.g. the primary automatically-recognized nail contour L1 and/or the border lines L2, L3) as the nail contours by changing the detection threshold.

In the adjusted automatic nail contour recognizing process according to Method 2, the nail contour recognizing section 512 performs automatic recognition so as to select the border line whose shape/size becomes nearest those of the adjusted nail contour RL among the plural border lines that may be recognized, by performing detection while varying the detection threshold or the like.

With respect to the portion (portion left as the primary automatically-recognized nail contour L1) that has not been adjusted in the nail contour adjusting process, the border same as the primary automatically-recognized nail contour that has been recognized by the primary automatic nail contour recognition is automatically recognized. This recognition result becomes the adjusted automatically-recognized nail contour.

Additionally, when executing the adjusted automatic nail contour recognizing process according to Method 2, it is preferable to obtain correction information such as an inclination deviation (angle deviation) and/or a size deviation (apparent size deviation due to a difference of distances from the camera 32, image ratio deviation) between the print target finger U1 at the time of obtaining the primary nail image and the print target finger U1 at the time of obtaining the secondary nail image, on the basis of the primary nail image data obtained by the primary photographing and the secondary nail image data obtained by the secondary photographing, and to previously reflect the correction information in the adjusted nail contour RL.

<Method 3>

The adjusted automatic nail contour recognizing process according to Method 3 is an adjusted automatic nail contour recognizing process to be executed in the case that Mode 3 or Mode 4 is selected as the adjustment mode in the nail contour adjusting process by the recognition result adjusting section 513.

In the adjusted automatic nail contour recognizing process according to Method 3, first, the nail contour recognizing section 512 obtains the secondary nail image, and reads out the adjusted nail contour(s) RL and the primary automatically-recognized nail contour L1 from the storage section 52.

Then the nail contour (nail shape) is automatically recognized based on the secondary nail image (the secondary automatic nail contour recognition).

Furthermore, the nail contour recognizing section 512 obtains the correction information such as the inclination deviation (angle deviation) and/or the size deviation (apparent size deviation due to a difference of distances from the camera 32, image ratio deviation) between the print target finger U1 at the time of obtaining the primary nail image and the print target finger U1 at the time of obtaining the secondary nail image, from the primary automatically-recognized nail contour L1 and the secondary automatically-recognized nail contour, and reflects the correction information in the adjusted nail contour RL.

After that, the nail contour recognizing section 512 incorporates the adjusted nail contour RL after the correction into a corresponding portion in the secondary automatically-recognized nail contour to produce the adjusted automatically-recognized nail contour.

Incidentally, the nail contour recognizing section 512 is not limited to the one that detects only the contour (shape) of the nail T as the nail information.

For example, the nail contour recognizing section 512 may detect other information such as a height (position in a vertical direction) of the nail T, a curvature (nail curvature) of the nail T, etc.

In this case, for example, a plurality of nail images are obtained by photographing the nail T of the print target finger U1 from among a plurality of different angles by using the camera 32, and the height and/or the curvature of the nail T are detected based on the nail images.

In the case that the nail contour recognizing section 512 detects also the nail height/curvature, printing can be executed with consideration for the shape of the nail T in a height direction, and thereby printing can be executed with a higher degree of accuracy.

The recognition result adjusting section 513 has a plurality of adjustment modes (nail contour adjustment modes) for adjusting at least a part of the contour (nail contour) of the nail T.

The recognition result adjusting section 513 adjusts the nail contour (primary automatically-recognized nail contour L1) that has been automatically recognized by the nail contour recognizing section 512 as the first nail contour recognizing section, on the basis of the selected adjustment mode.

In the adjustment mode, the nail contour adjustment screen is displayed on the display screen of the touch panel input section 122. On the nail contour adjustment screen, an image in which the primary automatically-recognized nail contour L1 that has been recognized in the primary automatic nail contour recognition is distinguishably superposed on the nail image is displayed. In FIG. 5A etc., the primary automatically-recognized nail contour L1 is drawn by a solid line, and a finger portion is drawn by two-dot chain lines.

Additionally, the display screen of the touch panel input section 122 may display only the primary automatically-recognized nail contour L1, or alternatively may display other borderlines (border lines L2, L3 in FIG. 5B etc.) that have been detected as the candidate nail contours together with the primary automatically-recognized nail contour L1.

When a user executes inputting by touching an adjustment target portion of the automatically-recognized nail contour (primary automatically-recognized nail contour L1) by using the input member such as the pen 123, the recognition result adjusting section 513 executes the nail contour adjusting process on the basis of the selected adjustment mode.

The nail contour after adjustment (hereinafter referred to as "adjusted nail contour RL"), which is the result of adjustment by the recognition result adjusting section 513, is stored in the adjusted nail contour memory 526.

The border branch points DP which are the starting and end points of the adjusted portion are stored in the border branch point memory 527.

In the embodiment, as described above, there are provided four kinds of adjustment modes: the automatic track judgment mode (Mode 1); the automatic point mode (Mode 2); the manual track mode A (Mode 3); and the manual track mode B (Mode 4), as the adjustment modes (see FIG. 4).

When a user selects any one of the mode numbers in the operation section 12, the recognition result adjusting section 513 refers to the adjustment mode table 523 to read out the content corresponding to the selected mode number, and performs the nail contour adjusting process according to the read-out content.

Incidentally, it is also possible to set any one of the adjustment modes by default. In this case, the recognition result adjusting section 513 performs the nail contour adjusting process according to the adjustment mode set by default as long as an instruction to change the adjustment mode is not especially input from the operation section 12.

Next, each of the adjustment modes will be specifically described with reference to the FIGS. 5A, 5B, 7A, 7B and 7C.

<Automatic Track Judgment Mode (Mode 1)>

Figure 5B:
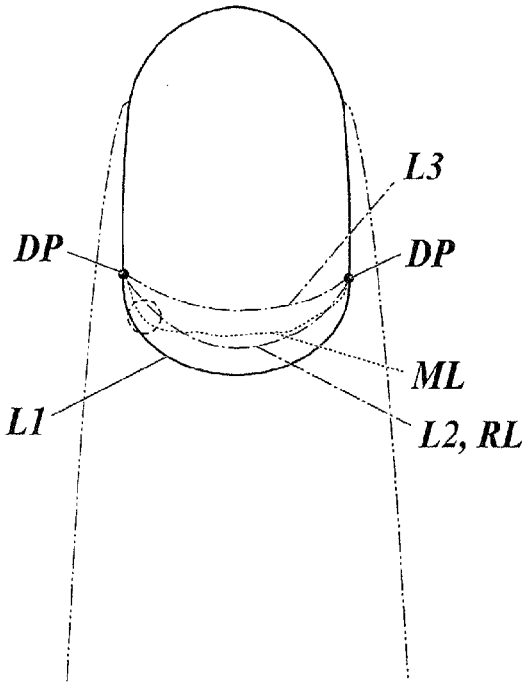

FIG. 5A and FIG. 5B are explanatory diagrams of the automatic track judgment mode (Mode 1).

As illustrated in FIG. 5A, in the automatic track judgment mode, a user traces the adjustment target portion of the primary automatically-recognized nail contour L1 with the pen 123, on the nail contour adjustment screen displayed in the touch panel input section 122 (the lines traced with the pen 123 are drawn by dash lines as "handwritten lines ML" in FIG. 5A and FIG. 5G).

The recognition result adjusting section 513 set the starting and end points of the portion traced with the pen 123 as the border branch points DP, and among the border lines that have been detected as the candidate nail contours by the nail contour recognizing section 512 in the primary automatic nail contour recognition, selects the border line (border line L2 in FIG. 5B) nearest the adjustment line traced with the pen 123 as the adjusted nail contour.

Here, there is considered a case where the border line L2 and the border line L3 (drawn by chain lines in FIG. 5B) are detected, in addition to the border line (drawn by the solid line in FIG. 5B) that has been set as the primary automatically-recognized nail contour L1, in the primary automatic nail contour recognition as illustrated in FIG. 5B.

In this case, the recognition result adjusting section 513 selects the border line (border line L2 in FIG. 5B) nearest the handwritten line (adjustment line) ML which a user traced with the pen 123.

Incidentally, also in the case that the border line nearest the handwritten line ML is the primary automatically-recognized nail contour L1 as in the portion enclosed with a dash-line circle in FIG. 5B, the recognition result adjusting section 513 selects the border line (border line L2 in FIG. 5B) nearest the handwritten line ML among the border lines which are not the primary automatically-recognized nail contour L1.

By executing the process in such a way, even when a user draws the handwritten line ML at a close position to the primary automatically-recognized nail contour L1, a proper border line can be selected while reflecting an intention of a user to adjust the original primary automatically-recognized nail contour L1.

Whether or not the border line is close to the handwritten line ML may be also judged by previously preparing a threshold for defining a range that can be said as being close, and determining the border line located within the range of the threshold as the border line close to the handwritten line ML.

In this case, if no border line is recognized within the range of a predetermined threshold, the display section 13 etc. may display that fact and/or an instruction screen prompting a user to re-execute the nail contour adjusting process.

The recognition result adjusting process 513 also smoothly connects the selected and adjusted border line and the unadjusted border portion (i.e. a portion left as the primary automatically-recognized nail contour L1) to each other so that unnatural unevenness does not occur in the nail contour, and thereby the adjusted nail contour RL is produced.

<Automatic Point Mode (Mode 2)>

FIGS. 6A to 6D are explanatory diagrams of the automatic point mode (Mode 2).

Figure 6A:
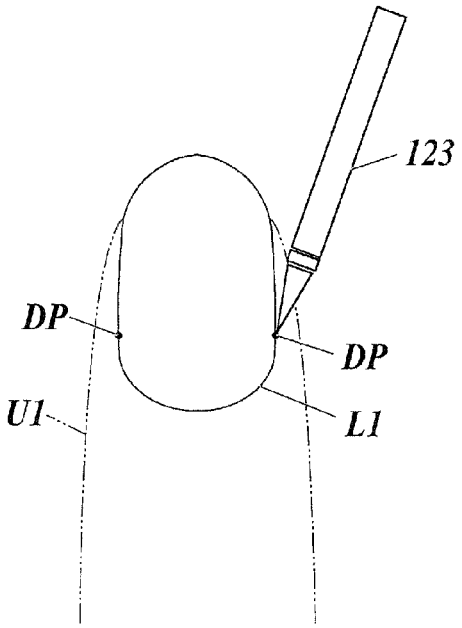
FIGS. 6A to 6D are diagrams for explaining an automatic point mode.

As illustrated in FIG. 6A, in the automatic point mode, a user touches the starting point and the end point (i.e. border branch points DP) of the adjustment target portion of the primary automatically-recognized nail contour L1 with the pen 123 on the nail contour adjustment screen displayed in the touch panel input section 122.

Similarly to the case of the above automatic track judgment mode (Mode 1), there is considered a case where the border line L2 and the border line L3 (drawn by chain lines in FIG. 5B) are detected, in addition to the border line (drawn by a solid line in FIG. 5B) regarded as the primary automatically-recognized nail contour L1, in the primary automatic nail contour recognition as illustrated in FIG. 5B.

The recognition result adjusting section 513 sets the border line, among the border lines (border lines L2, L3 in FIG. 6B) that have been detected as the candidate nail contours by the nail contour recognizing section 512 in the primary automatic nail contour recognition, which is nearest the line obtained by smoothly connecting the points input by touch operations, as the adjusted nail contour RL.

Figure 6C:
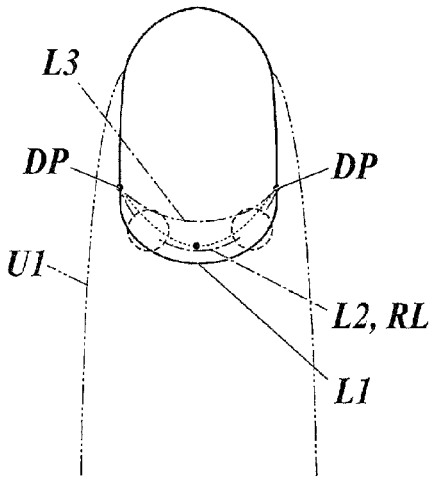
Figure 6B:
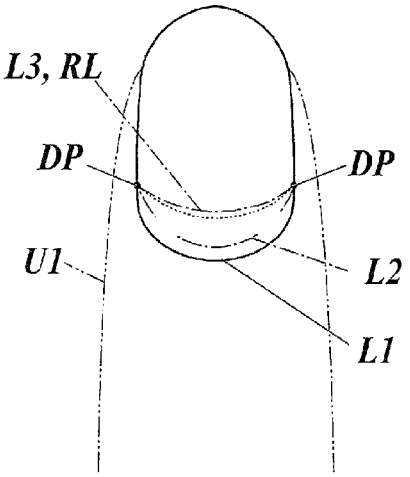

For example, in the case that the points input by the touch operations are only the border branch points DP as illustrated in FIG. 6B, the border line L3 which is the nearest border line with respect to the line (drawn by the dash line in FIG. 6B) obtained by connecting these two points to each other is set as the adjusted nail contour RL.

In the case that one more point between the two border branch points DP is touched by touch operation as illustrated in FIG. 6C, the border line L2 which is the nearest border line with respect to the line (drawn by the dash line in FIG. 6C) obtained by connecting these three points to one another is set as the adjusted nail contour RL.

Here, all of the border lines that have been detected as the candidate nail contours by the nail contour recognizing section 512 in the primary automatic nail contour recognition do not always continue smoothly.

For example, in the case that the condition of the border portion between the cuticle and the nail T or between the finger and the nail T is uneven, and/or in the case that a part of the nail is discolored, the border lines cannot be recognized successfully, and sometimes become discontinuous (e.g. portions enclosed with dash-line circles in FIG. 6C).

When there are such blurred/disconnected portions in the border line originally recognized by the nail contour recognizing section 512, an intended border line (e.g. the border line L2 in FIG. 6C) cannot sometimes be obtained even when the recognition result adjusting section 513 connects the touched points.

Figure 6D:
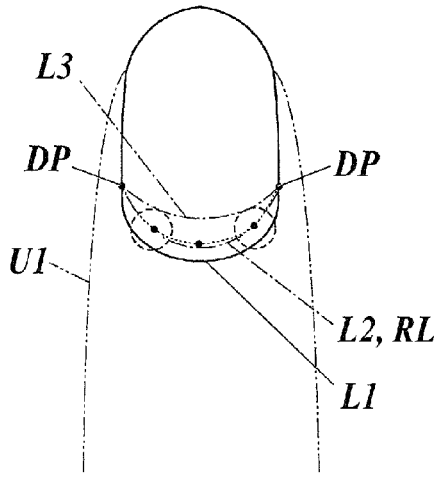

Thus, if the adjustment result by the recognition result adjusting section 513 is deviated from the border line that is original adjustment target, as illustrated in FIG. 6D, a user may touch another point(s) (points in regions enclosed with dash-line circles in FIG. 6D) on the border line which the user intends to adjust.

Then, the recognition result adjusting section 513 smoothly connects all of the points that has been touched by operation on the nail contour adjustment screen, and thereby the portions that have been difficult to be recognized by the nail contour recognizing section 512 can be compensated. This can cause the border line having a proper shape to be the adjusted nail contour RL.

Additionally, adjusting the recognition result adjusting section 513 is not limited to setting the border line, among the border lines detected as the candidate nail contours by the nail contour recognizing section 512 in the primary automatic nail contour recognition, which is nearest the line obtained by connecting the touched points, as the adjusted nail contour RL.

For example, the line itself, which is obtained by connecting the touched points, can be set as the adjusted nail contour RL.

<Manual Track Mode (Mode 3), Manual Track Mode (Mode 4)>

Figure 7A:
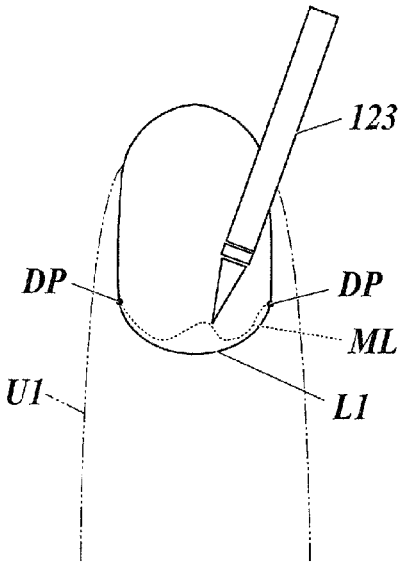
FIG. 7A is a diagram illustrating a way of handwriting an adjustment border by a user.
Figure 7B:
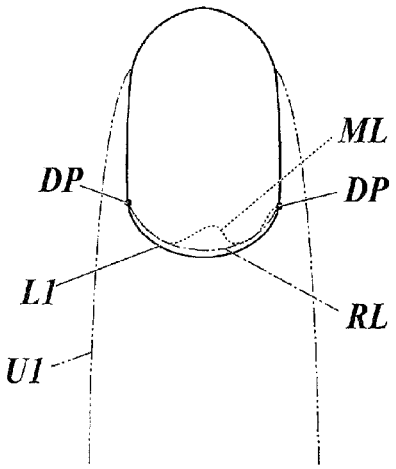
FIG. 7B is a diagram illustrating an adjusted nail contour in the case of manual track mode A.
Figure 7C:
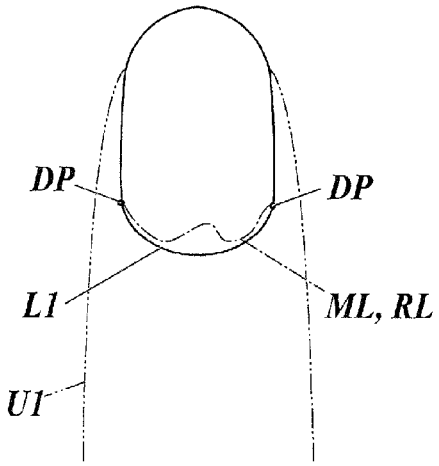
FIG. 7C is a diagram illustrating an adjusted nail contour in the case of manual track mode B.

FIGS. 7A to 7C are explanatory diagrams of the manual track mode A (Mode 3) and the manual track mode B (Mode 4).

As illustrated in FIG. 7A, in the manual track mode A and the manual track mode B, a user traces the adjustment target portion of the primary automatically-recognized nail contour L1 with the pen 123, on the nail contour adjustment screen displayed in the touch panel input section 122. In FIG. 7A and FIG. 7B, the lines traced with the pen 123 are drawn by dash lines as "handwritten lines ML".

In the manual track mode A, as illustrated in FIG. 7B, the recognition result adjusting section 513 corrects the handwritten line ML so that an unnatural (human-induced) unevenness does not occur in the nail contour, to produce the after-adjustment border line (drawn by a chain line in FIG. 7B).

Moreover, the recognition result adjusting section 513 smoothly connects the after-adjustment border line and the unadjusted border portion (i.e. the portion left as the primary automatically-recognized nail contour L1) to each other so that an unnatural unevenness does not occur in the nail contour, to produce the adjusted nail contour RL.

Meanwhile, in the manual track mode B, as illustrated in FIG. 7C, the recognition result adjusting section 513 directly (without adjustment) sets the handwritten line ML, that has been input through the touch operation by a user, as the adjusted nail contour RL.

The print control section 514 outputs print data based on the image data of the nail design(s) to the print head 46 of the printing section 40, and controls the printing section 40 so that the print head 46 performs printing to the nail T according to the print data.

In the embodiment, the control section 51 incorporates the image data of the nail design selected by a user operation in the operation section 12 etc. into the adjusted automatically-recognized nail contour recognized by the nail contour recognizing section 512 (the second nail contour recognizing section), namely, performs fitting of the image data of the nail design to the adjusted automatically-recognized nail contour. Then the control section 51 creates print data whose print target region is within the region of the adjusted automatically-recognized nail contour.

The print control section 514 controls the print head 46 to execute printing according to the created print data.

As described above, in the embodiment, the image data of the nail designs stored in the design data memory 522 are rectangular data each having a large size. Each piece of print data is generated by properly reducing each piece of image data of the nail designs so that it fits the contour of the nail T.

Incidentally, the specific method of the incorporating process is not especially limited.

For example, each piece of print data is generated by reducing each piece of image data of the nail designs so that it has a size which does not protrude from the region of the adjusted automatically-recognized nail contour, with a shorter length among horizontal and vertical lengths of the print target nail T as a reference, and incorporating the reduced image data into the region of the adjusted automatically-recognized nail contour.

The display control section 515 controls the display section 13 to display various kinds of display screens.

In the embodiment, the display control section 515 controls the display section 13 to display, for example, the nail image(s) obtained by photographing the print target finger U1, the design selection screen for selecting the image (i.e. "nail design") to be printed on the nail T, the thumbnail image(s) for confirming the design(s), the instruction screen for displaying various instructions, and so on.

The display control section 515 causes the display section 13 to display the primary automatically-recognized nail contour L1 that has been automatically-recognized by the nail contour recognizing section 12 (the first nail contour recognizing section).

As described above, the display section 13 is equipped with the touch panel input section 122 integrally formed therewith, and the display screen on which the primary automatically-recognized nail contour L1 is displayed functions as the nail contour adjustment screen on which touch operations with the pen 123 or the like are possible.

Next, the printing method using the nail printing device 1 according to the embodiment will be described with reference to the FIGS. 8 to 13, etc.

When executing printing by using the nail printing device 1, first, a user turns on the power switch to activate the control device 50.

The display control section 515 causes the display section 13 to display the design selection screen.

A user operates the operation button 121 etc. of the operation section 12 to select an intended nail design from among the plurality of nail designs displayed on the design selection screen.

By this, a selection instruction signal is output from the operation section 12, and one (1) nail design is selected (Step S1).

Next, the display control section 515 causes the display section 13 to display the instruction screen for instructing a user to set the print target finger U1 (nail T) in the device (Step S2).

Then, as illustrated in FIG. 2, a user inserts the print target finger U1 into the print target finger/toe insertion section 20A.

When setting of the print target finger U1 is thus completed, the photographing control section 511 controls the photographing section 30 to perform photographing (primary photographing) of the nail T of the print target finger U1 to obtain the nail image (primary nail image) (Step S3).

At that time, the display control section 515 causes the display section 13 to display, in real time, the image of the print target finger U1 photographed by the photographing section 30 so that a user can recognize whether or not the print target finger U1 is set in a predetermined position.

When the nail image (primary nail image) is obtained, the nail contour recognizing section 512 (first nail contour recognizing section) automatically recognizes the nail contour from the nail image (Step S4; primary automatic nail contour recognition).

When the nail contour is recognized, the display control section 515 causes the display section 13 to display the primary automatically-recognized nail contour L1 as the recognition result (Step S5). At that time, the display control section 515 causes the display section 13 to display, while displaying the nail image of the print target finger U1 photographed by the photographing section 30 in real time, the primary automatically-recognized nail contour L1 so that it is superposed on the nail image.

Then, the display control section 515 makes an inquiry to a user about whether or not the recognition result is appropriate (Step S6). Specifically, for example, the display section 13 displays not-illustrated OK button and NO button, and judgment is made as to whether or not any one of the buttons is operated.

When the NO button is operated (Step S6; No), the nail contour adjusting process according to the nail contour adjustment mode is performed (Step S7).

When executing the nail contour adjusting process, a user draws his/her hand including the print target finger U1 out of the nail printing device 1.

After that, a user executes the subsequent nail contour adjusting process in the state that the hand including the print target finger U1 is not inserted into the nail printing device 1.

Here, the nail contour adjusting process (Step S7) will be described with reference to FIG. 9.

Figure 9:
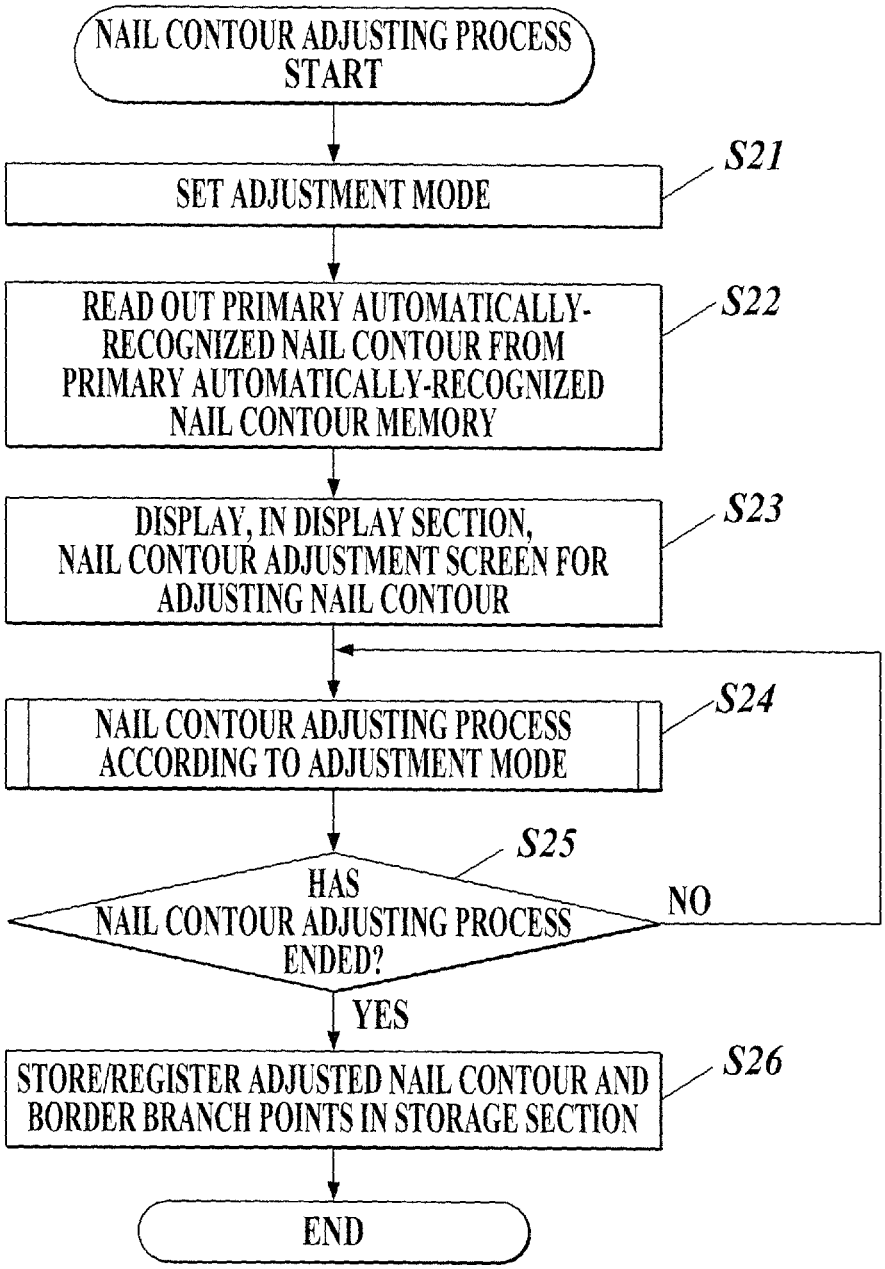
FIG. 9 is a flowchart illustrating a nail contour adjusting process in FIG. 8.

As illustrated in FIG. 9, in the nail contour adjusting process, first, any one of the plural adjustment modes is selected to be set according to the instruction etc. input from the operation section 12 (Step S21).

Incidentally, in the case that any one of the adjustment modes is set by default and no instruction is input from the operation section 12, the adjustment mode is automatically set to be the mode set by default.

The recognition result adjusting section 513 reads out the primary automatically-recognized nail contour L1 from the primary automatically-recognized nail contour memory (Step S22).

The display section 13 then displays the nail contour adjustment screen for adjusting the primary automatically-recognized nail contour L1 (Step S23).

The nail contour adjustment screen displays the image in which the primary automatically-recognized nail contour L1 that has been recognized in the primary automatic nail contour recognition is superposed on the nail image of the print target finger U1 based on the image data read out from the primary nail image memory 524. By this, a user does not need to insert his/her hand including the print target finger U1 into the nail printing device 1 when performing the nail contour adjusting process.

The display screen displaying the primary automatically-recognized nail contour L1 functions as the nail contour adjustment screen on which touch operations with the pen 123 etc. are possible.

Here, a user performs the touch operations on the display screen so that the intended border line becomes the nail contour.

The recognition result correcting section 513 executes, on the basis of the results of the touch operations, the nail contour adjusting process according to the adjustment mode that has been selected and set (Step S24).

Then the control section 51 judges whether or not the nail contour adjusting process ends (Step S25).

When the nail contour adjusting process does not end, the control section 51 returns to Step S24 and repeats the process.

On the other hand, when it is judged that the nail contour adjusting process ends, the adjusted nail contour RL as the adjustment result is stored (registered) in the adjusted nail contour memory 526. The border branch points DP are then stored (registered) in the border branch point memory 527, and the process ends.

Figure 8:
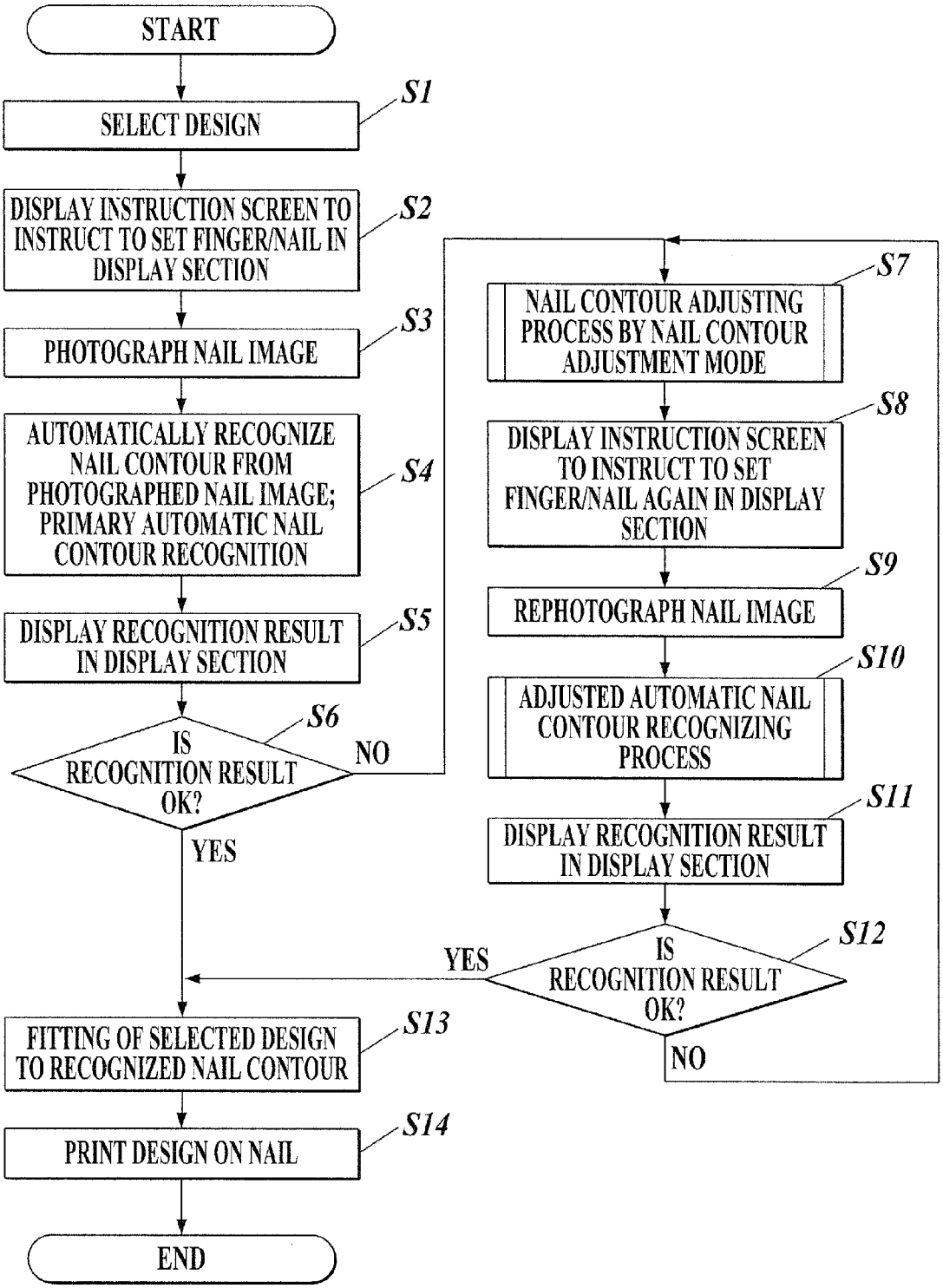
FIG. 8 is a flowchart illustrating a flow of an entire printing process according to the embodiment.

When the nail contour adjusting process ends, the processing returns to FIG. 8, and the display control section 515 causes the display section 13 to display the instruction screen for instructing a user to set the print target finger U1 (nail T) same as that of the above nail contour adjusting process in the device again (Step S8).

When setting of the print target finger U1 is completed, the photographing control section 511 controls the photographing section 30 to execute re-photographing (secondary photographing) of the nail T of the print target finger U1 to obtain the nail image (secondary nail image) (Step S9).

When the nail image (secondary nail image) is obtained, the nail image recognizing section 512 (second nail contour recognizing section) performs the adjusted automatic nail contour recognizing process (Step S10).

Here, the adjusted automatic nail contour recognizing process (Step S10) will be described with reference to FIGS. 10 to 13.

Figure 10:
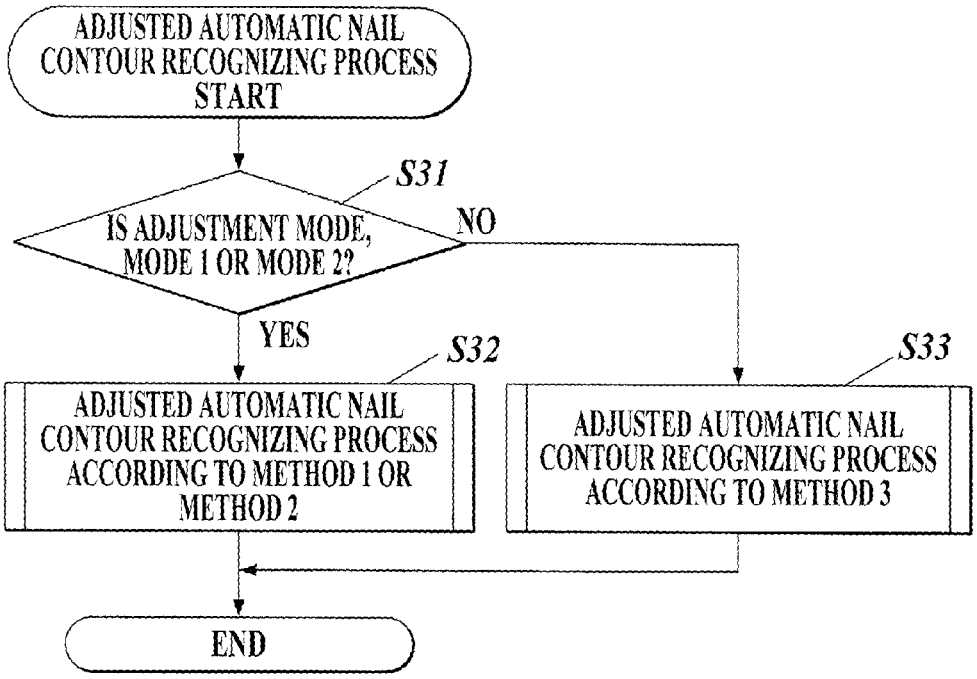
FIG. 10 is a flowchart illustrating a flow of an entire adjusted automatic nail contour recognizing process in FIG. 8.

As illustrated in FIG. 10, in the adjusted automatic nail contour recognizing process, first, whether or not the nail contour adjusting process (Step S7; see FIG. 9) has been executed according to the adjustment mode of Mode 1 or Mode 2 is judged (Step S31).

When it is judged that the nail contour adjusting process has been executed according to the adjustment mode of Mode 1 or Mode 2 (Step S31; YES), the adjusted automatic nail contour recognizing process is performed by Method 1 or Method 2 (Step S32).

In this case, whether the adjusted automatic nail contour recognizing process is performed by Method 1 or Method 2 may be set by default, or alternatively, may be freely set by a user.

On the other hand, when it is judged that the nail contour adjusting process has not been executed according to the adjustment mode of Mode 1 or Mode 2 (i.e. in the case that the nail contour adjusting process has been executed according to the adjustment mode of Mode 3 or Mode 4: Step S31; NO), the adjusted automatic nail contour recognizing process is performed by Method 3 (Step S33).

<Method 1>

Figure 11:
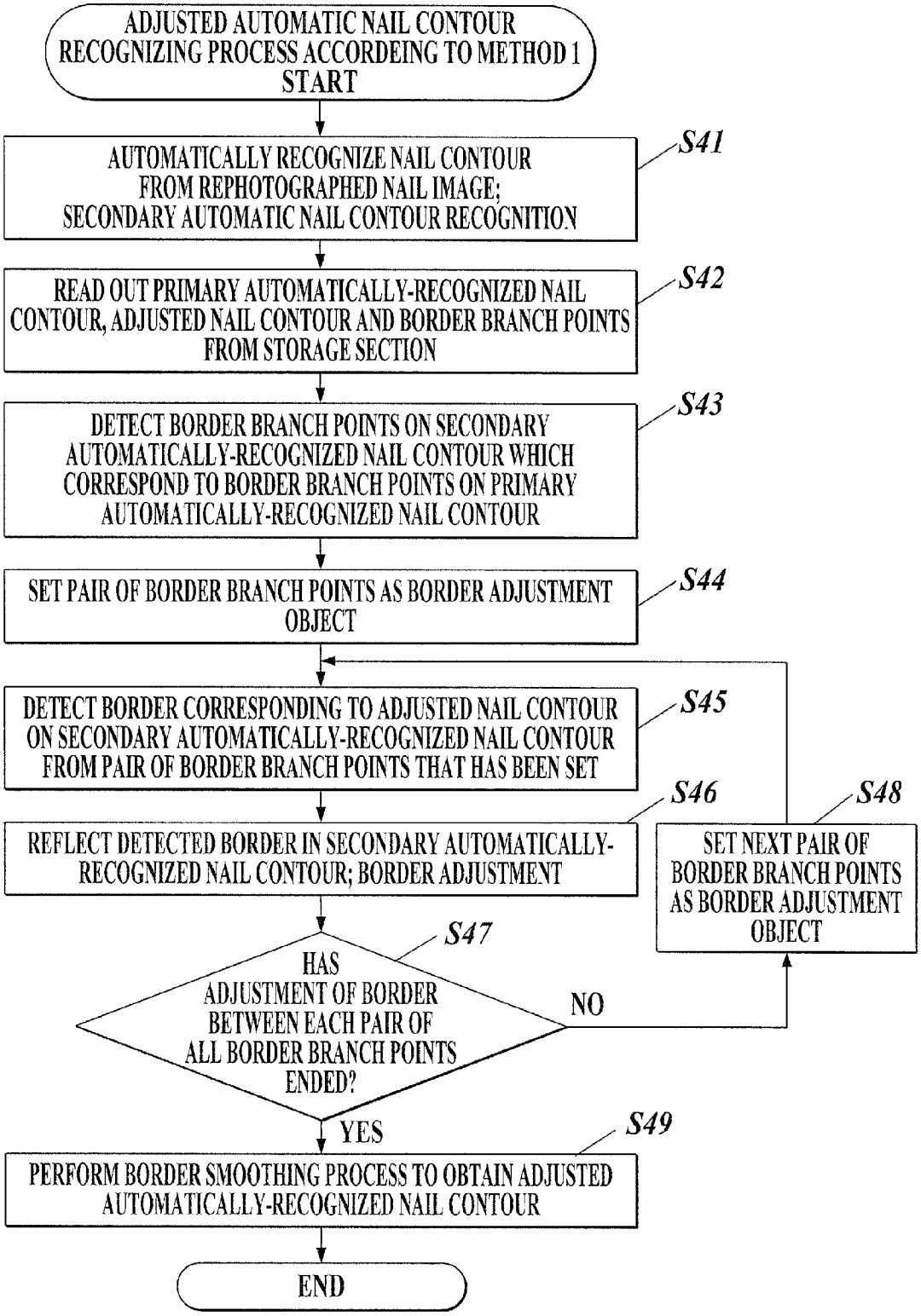
FIG. 11 is a flowchart illustrating an adjusted automatic nail contour recognizing process according to Method 1 in FIG. 10.

Next, the adjusted automatic nail contour recognizing process according to Method 1 will be described with reference to FIG. 11.

In the adjusted automatic nail contour recognizing process according to Method 1, first, the nail contour recognizing section 512 automatically recognizes the nail contour from the re-taken nail image (secondary automatic nail contour recognition) (Step S41).

Then, the primary automatically-recognized nail contour L1, the adjusted nail contour RL and the border branch points DP are read out from the storage section 52 (Step S42).

The nail contour recognizing section 512 then detects the points (border branch points on the secondary automatically-recognized nail contour) on the secondary automatically-recognized nail contour which correspond to the border branch points DP of the primary automatically-recognized nail contour L1 (Step S43).

When the border branch points on the secondary automatically-recognized nail contour are detected, the nail contour recognizing section 512 sets one pair of the border branch points as the objects of border adjustment (Step S44).

The nail contour recognizing section 512 then detects the border corresponding to the adjusted nail contour RL on the secondary recognized nail contour, based on the one pair of the border branch points that has been set (Step S45).

Furthermore, the nail contour recognizing section 512 reflects the detected border in the secondary automatically-recognized nail contour, namely performs border adjustment (Step S46).

The nail contour recognizing section 512 then judges whether or not adjustment of the border between each pair of all the border branch points has been completed (Step S47).

When there are two or more sets of border branch points and border adjustment has not partially been completed (Step S47; NO), next pair of border branch points, for which border adjustment has not been completed, is set as the object of border adjustment (Step S48).

Thus, the processes of Step S45 to Step S48 are repeated until adjustment of the border between each pair of all the border branch points has been completed.

When it is judged that adjustment of the border between each pair of all the border branch points has been completed (Step S47; YES), smoothing process to smoothly connect the adjusted border portion and the unadjusted border portion (portion left as the primary automatically-recognized nail contour L1) is performed so that the border does not become unnatural.

The nail contour after adjustment is then set as the adjusted automatically-recognized nail contour (Step S49).

<Method 2>

Figure 12:
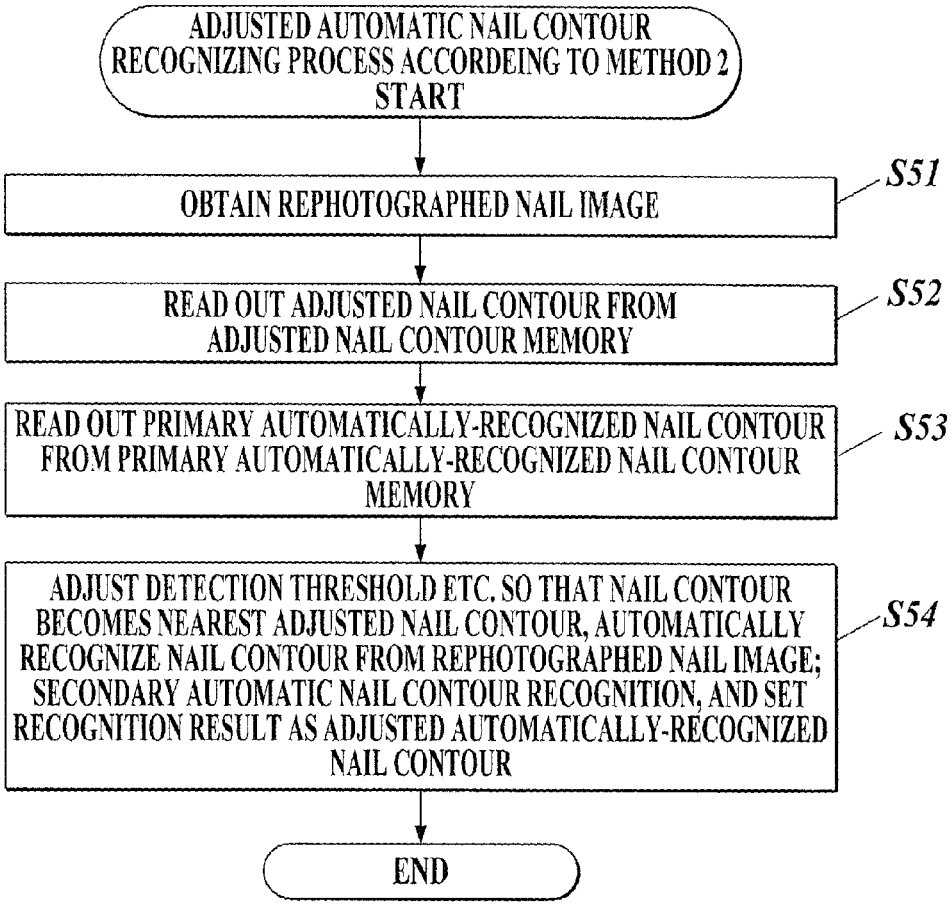
FIG. 12 is a flowchart illustrating an adjusted automatic nail contour recognizing process according to Method 2 in FIG. 10.

Next, the adjusted automatic nail contour recognizing process according to Method 2 will be described with reference to FIG. 12.

In the adjusted automatic nail contour recognizing process according to Method 2, first, the nail contour recognizing section 512 obtains the re-taken (secondary-photographed) nail image (secondary nail image) (Step S51).

Then, the nail contour recognizing section 512 reads out the adjusted nail contour RL from the adjusted nail contour memory 526 (Step S52).

The nail contour recognizing section 512 then reads out the primary automatically-recognized nail contour L1 from the primary automatically-recognized nail contour memory 525 (Step S53).

Moreover, the nail contour recognizing section 512 obtains the correction information such as an inclination deviation (angle deviation) and/or a size deviation (apparent size deviation due to a difference of distances from the camera 32, image ratio deviation) between the print target finger U1 at the time of obtaining the primary nail image and the print target finger U1 at the time of obtaining the secondary nail image, from the data of the primary nail image and the data of the secondary nail image, and reflects the obtained correction information in the adjusted nail contour RL to correct the adjusted nail contour RL.

Then, the nail contour recognizing section 512 automatically recognizes the nail contour from the re-taken nail image (secondary nail image) while varying the detection threshold etc. (secondary automatic nail contour recognition), and sets the detection threshold etc. so that the automatically-recognized nail contour has the shape nearest the adjusted nail contour RL after the correction.

At that time, in the region that has not been adjusted in the nail contour adjusting process, the border same as the primary automatically-recognized nail contour, which has been recognized by the primary automatic nail contour recognition, is automatically recognized.

Then this recognition result is set as the adjusted automatically-recognized nail contour (Step S54).

<Method 3>

Figure 13:
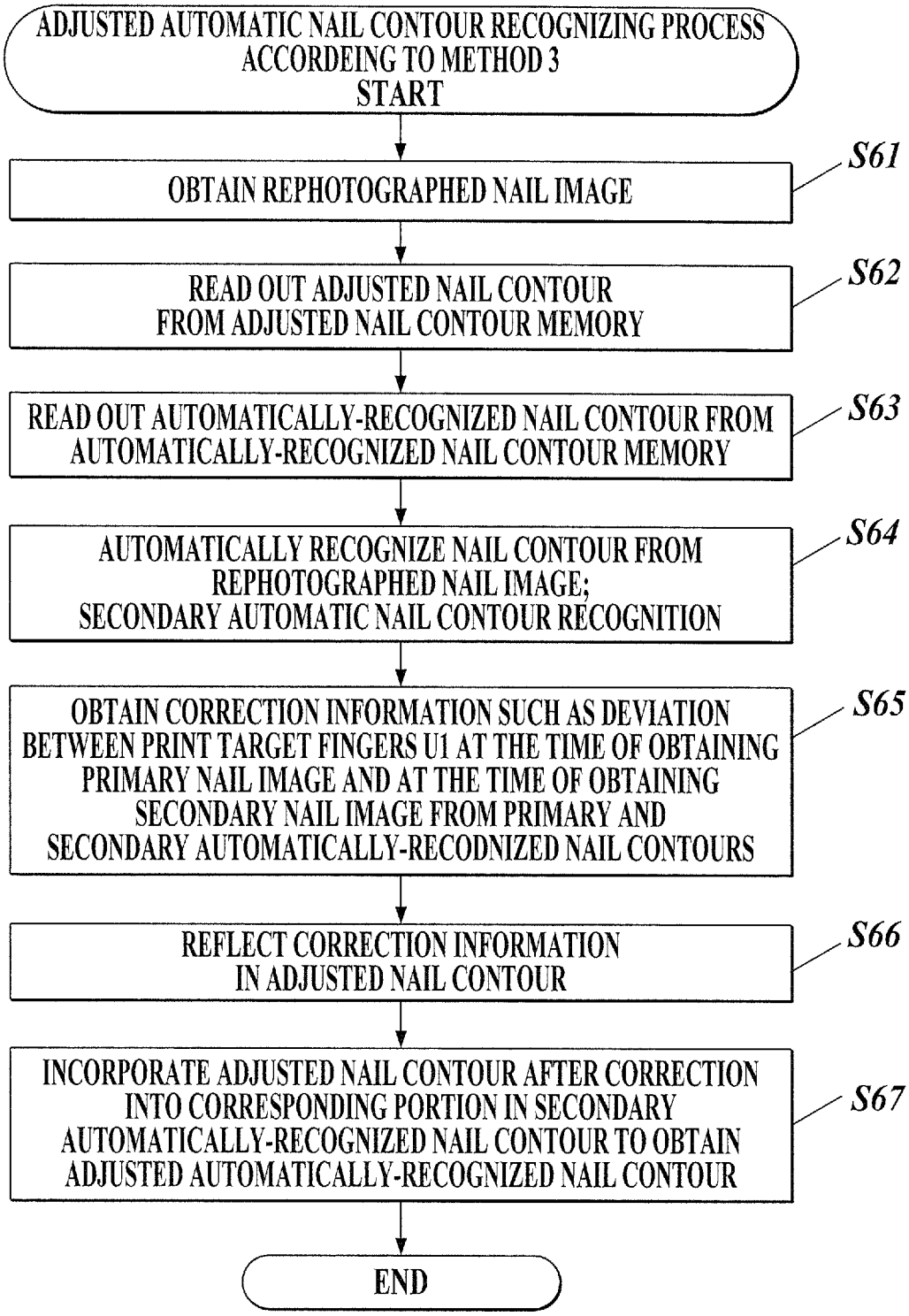
FIG. 13 is a flowchart illustrating an adjusted automatic nail contour recognizing process according to Method 3 in FIG. 10.

Next, the adjusted automatic nail contour recognizing process according to Method 3 will be described with reference to FIG. 13.

In the adjusted automatic nail contour recognizing process according to Method 3, first, the nail contour recognizing section 512 obtains the re-taken (secondary-photographed) nail image (secondary nail image) (Step S61).

Then, the nail contour recognizing section 512 reads out the adjusted nail contour RL from the adjusted nail contour memory 526 (Step S62)

The primary automatically-recognized nail contour L1 is then read out from the primary automatically-recognized nail contour memory 525 (Step S63).

After that, the nail contour recognizing section 512 automatically recognizes the nail contour (nail shape) based on the secondary nail image (Step S64; secondary automatic nail contour recognition).

Moreover, the nail contour recognizing section 512 obtains the correction information such as an inclination deviation (angle deviation) and/or a size deviation (apparent size deviation due to a difference of distances from the camera 32, image ratio deviation) between the print target finger U1 at the time of obtaining the primary nail image and the print target finger U1 at the time of obtaining the secondary nail image, from the primary automatically-recognized nail contour L1 and the secondary automatically-recognized nail contour (Step S65).

Then the obtained correction information is reflected in the adjusted nail contour RL to correct the adjusted nail contour RL (Step S66).

After that, the adjusted nail contour RL after the correction is incorporated into the corresponding portion in the secondary automatically-recognized nail contour. Thus the adjusted automatically-recognized nail contour is obtained (Step S67).

Returning to FIG. 8, when the adjusted automatic nail contour recognizing process (Step S10) ends, the display control section 515 causes the display section 13 to display the adjusted automatically-recognized nail contour which is the recognition result (Step S11).

Then an inquiry is made to a user about whether or not the recognition result is appropriate (Step S12).

Specifically, for example, the display section 13 displays not-illustrated OK button and NO button, and judgment is made as to whether or not any one of the buttons is operated.

When the NO button is operated (Step S12; NO), the processing returns to Step S7 again, and the above processes are repeated.

On the other hand, when the primary automatically-recognized nail contour L1 that is the recognition result is appropriate (i.e. when the OK button is operated with respect to the recognition result by the nail contour recognizing section 512 as the primary nail contour recognizing section: Step S6; YES), or when the adjusted automatically-recognized nail contour is appropriate (i.e. the OK button is operated with respect to the recognition result by the nail contour recognizing section 512 as the secondary nail contour recognizing section: Step S12; YES), the control section 51 executes fitting of the nail design selected in Step S1 to the recognized nail contour (Step S13).

Then the print head 46 prints the nail design on the nail T (Step S14).

As described above, according to the embodiment, the nail contour recognizing section 512 as the first nail contour recognizing section automatically recognizes the contour of the nail T of the print target finger U1 inserted into the print target finger/toe insertion section 20A. Then, in the case that the primary automatically-recognized nail contour L1 as the result of automatic recognition is different from the print range intended by a user, the recognition result is adjusted in the state that the hand including the print target finger U1 is drawn out of the nail printing device 1.

After that, the print target finger U1 is inserted into the print target finger/toe insertion section 20A again, and automatic recognition of the contour of the nail T of the print target finger U1 is performed. The adjustment result thus obtained can be reflected in the nail contour in which printing is to be performed.

This enables a user to execute adjusting work of the nail contour while freely using both hands including a dominant hand, and the result of the automatic recognition of the nail contour can be easily adjusted so that it becomes the contour intended by a user.

Also in the case that there is the portion (e.g. portions enclosed with the dash-line circles in FIG. 6C etc.) difficult to be recognized only by automatic recognition, for example, in the case that the nail T and/or finger contains a cut and/or color unevenness, a user can adjust the result of automatic recognition, and thereby a proper border intended by a user can be recognized as the nail contour. By this, an accuracy of automatic recognition of the nail contour can be improved.

Moreover, there are provided the plurality of adjustment modes for adjusting at least a part of the contour of the nail T, and the adjustment mode can be selected from among them. By this, the result of automatic recognition of the nail contour can be adjusted according to the method intended by a user.

As such adjustment mode, there is provided the mode in which among the plurality of border lines recognized in the automatic recognition, the contour of the nail T including the border line nearest the line input by a user from the touch panel input section is set as the automatic nail contour RL.

Then, the adjusted nail contour RL can be reflected in the recognition result obtained by performing the secondary automatic nail contour recognition to produce the adjusted automatically-recognized nail contour which is to be the final print region.

By this, even in the case that the nail contour manually adjusted by a user does not become a smooth and proper border line, a proper nail contour can be recognized while reflecting an intention of a user.

Furthermore, there is a case that a user does not want to perform printing even in the region recognized as being within the range of the nail contour in the automatic recognition, for example, for the reason that the nail T contains a cut and/or that the cuticle is not cared.

In this regard, the embodiment includes the mode in which the nail contour adjusted by handwriting of a user is directly set as the adjusted nail contour RL.

For this reason, the portion that is not recognized as the border in the automatic recognition can be recognized as the nail contour, and thereby the print range according to the intention of a user can be set.

Also in this case, the nail contour recognizing section 512 as the secondary nail contour recognizing section sets, as the adjusted automatically-recognized nail contour, the contour corresponding to the adjusted nail contour RL in the result of the automatic re-recognition (secondary automatic nail contour recognition) of the nail contour.

By this, even if the set position of the nail T during the primary automatic nail contour recognition and the set position of the nail T during the secondary automatic nail contour recognition are deviated from each other, printing can be executed at a proper position while considering such deviation.

Additionally, in the case that the plurality of border lines are recognized in the automatic recognition, it is also possible to reflect the adjusted nail contour RL in the automatic recognition and perform the secondary automatic nail contour recognition so that the border near the adjusted nail contour RL is recognized as the nail contour while adjusting the detection threshold.

By this, a user can easily specify the nail contour according to the intention of a user among the plurality of candidate nail contours, and thereby an accuracy of automatic recognition can be improved easily and swiftly.

Although the embodiment of the present invention is described above, it is indisputable that the present invention is not limited to such embodiment and various modifications can be added thereto.

For example, the above embodiment describes the case that there are provided four adjustment modes, Mode 1 to Mode 4, as the nail contour adjustment modes, but the number of the adjustment modes included in the nail print device 1 is not limited to four as long as the plural adjustment modes are provided.

For example, the nail printing device 1 does not need to include all of the adjustment modes illustrated in the embodiment. Alternatively, nail printing device 1 may include a larger number of adjustment modes than that of the embodiment.

Moreover, though the above embodiment describes the case that there are prepared three method, Method 1 to Method 3, for the adjusted automatic nail contour recognizing process, the number of methods is not limited to three.

The nail printing device 1 does not need to include all of the three method, or alternatively, may include another method(s) in addition the three method illustrated above.

Furthermore, the method of automatic recognition (primary automatic nail contour recognition and secondary automatic nail contour recognition) of the nail contour by the nail contour recognizing section 512 is not limited those illustrated above.

For example, it is also possible to divide the nail T into some characteristic portions such as a tip portion, a base portion, a right portion, a left portion, an edge portion and other portions, to preciously store a typical shape in each of the portions of the nail T in the storage section 52 etc., and to recognize the border line nearest the typical nail contour of each of the regions as the nail contour when automatically recognizing the nail contour.

In this way, the shape like the nail T can be recognized as the nail contour more certainly.

The range in which the secondary automatic nail contour recognition is performed is not limited to the example illustrated in the above embodiment.

Concretely, also in the case that the adjusted automatic nail contour recognizing process is executed by any of the methods, it is possible to perform the automatic re-recognition with respect to only the portion (portion between a pair of border branch points DP) that has been adjusted in the nail contour adjusting process in the secondary automatic nail contour recognition. Alternatively, the automatic re-recognition can be performed with respect to not only the portion adjusted in the nail contour adjusting process, but the entire nail T.

Moreover, the embodiment describes the case that the primary automatically-recognized nail contour L1 is displayed while being superposed on the primary nail image on the nail contour adjustment screen for adjusting the nail contour. However, the nail contour adjustment screen is not limited to the examples illustrated herein.

The display screen of the nail contour adjustment screen just has to perform displaying so that a user can understand which of regions in the nail T has been recognized as the print target nail contour (i.e. which of the regions the nail design is to be printed in).

For example, the display screen may display only the primary automatically-recognized nail contour L1, or display all of the border lines that have been recognized as the candidate nail contours as the result of the primary automatic nail contour recognition.

It is also possible to display not only the primary automatically-recognized nail contour L1 and/or the primary nail image, but also the nail design to be printed so that it is superposed thereon.

Furthermore, the above embodiment describes the example that the nail printing device 1 is equipped with the touch panel input section 122 integrated into the display section 13 so that inputting for nail contour adjustment can be performed by direct touch operations using the pen 123 etc. However, the inputting method for nail contour adjustment is not limited to the above.

For example, inputting for nail contour adjustment can be performed by using a pointing device such as a mouse while looking at the display screen of the display section 13. In this case, it is not essential to include the touch panel input section 122.

Moreover, though the above embodiment describes the case that the storage section 52 includes the border branch point memory 527 that stores the border branch points DP, it is not essential to provide the border branch point memory 527.

For example, it is also possible to store the adjusted nail contour RL and the border branch points DP corresponding to the starting and end points of the adjustment portion in the adjusted nail contour RL in the adjusted nail contour memory 526, so that the adjusted nail contour RL and the border branch points DP correspond to each other.

Furthermore, the above embodiment describes the example that the storage section 52 of the control device 50 includes the program memory 521, the design data memory 522, the adjustment mode table 523, etc. However, the program memory 521, the design data memory 522, the adjustment mode table 523, etc. do not always need to be included in the storage section 52 (ROM, RAM) of the control device 50, and it is also possible to provide a separate storage section.

Additionally, the above embodiment describes the example of the nail printing device 1 which sequentially performs printing while the fingers are inserted into the device one by one, but the present invention can also be applied to the device that can perform printing with respect to four fingers concurrently.

Although some embodiments of the present invention are described above, the scope of the present invention is not limited to the above embodiment and includes the scope of the invention of the claims and the scope of equivalents thereof.

What is claimed is:

1. A nail printing device comprising:

a storage section;

a first nail contour recognizing section which recognizes, as a first nail contour, a nail contour from a first nail image obtained by photographing a nail of a specific finger/toe and stores the first nail contour in the storage section;

a display section which displays the first nail contour on the basis of data of the first nail contour stored in a storage section;

a recognition result adjusting section which, on the basis of a nail contour adjusting process performed with respect to a first specified portion specified along a part of the first nail contour displayed on the display section, performs an adjustment of a shape of the first specified portion of the first nail contour without adjusting another part of the first nail contour than the first specified portion, obtains an adjusted nail contour and stores information on the adjustment performed to the first specified portion in the storage section;

a second nail contour recognizing section which recognizes, as a second nail contour, a nail contour from a second nail image obtained by photographing the nail of the specific finger/toe after the recognition result adjusting section performs the adjustment of the shape of the first specified portion of the first nail contour, reflects on the second nail contour the information on the adjustment performed to the first specified portion of the first nail contour, the information being read out from the storage section, performs an adjustment of a shape of a second specified portion specified on a part of the second nail contour corresponding to the first specified portion without adjusting another part of the second nail contour than the second specified portion and obtains an adjusted recognized nail contour; and a print control section to control a print head to perform printing in a region of the adjusted recognized nail contour.

2. The nail printing device of claim 1, further comprising a finger/toe insertion section into which a finger/toe is to be inserted, wherein performing the adjustment of the shape of the first specified portion of the first nail contour is executed in the state that the specific finger/toe is not inserted into the finger/toe insertion section.

3. The nail printing device of claim 1, further comprising a finger/toe insertion section into which a finger/toe is to be inserted and a photographing section to photograph the nail of the finger/toe inserted into the finger/toe insertion section, wherein the display section displays the first nail image and the first nail contour on the basis of the image being photographed by the photographing section when the specific finger/toe is inserted into the finger/toe insertion section, and the display section displays the first nail image and the first nail contour on the basis of the data stored in the storage section when the specific finger/toe is not inserted into the finger/toe insertion section.

4. The nail printing device of claim 1, further comprising an operation section which receives an input to specify the first specified portion with respect to the first nail contour, wherein the first nail contour recognizing section detects a plurality of first candidate nail contours different from the first nail contour, the operation section, in accordance with the input to specify the first specified portion, specifies at least two different points on the first nail contour as first border branch points, and the recognition result adjusting section specifies the first specified portion between two first border branch points and selects a nail contour which is nearest to a line obtained by smoothly connecting the first branch points with respect to the first nail contour, from among the plurality of first candidate nail contours, as a first adjusted nail contour, and adjusts the first nail contour by using the first border branch points and the first adjusted nail contour.

5. The nail printing device of claim 4, wherein the second nail contour recognizing section detects a plurality of second candidate nail contours different from the second nail contour, detects points on the second nail contour, the points corresponding to the first border branch points, as second border branch points, detects a nail contour corresponding to the first adjusted nail contour from among the plurality of second candidate nail contours as a second adjusted nail contour, and adjusts the second nail contour by using the second border branch points and the second adjusted nail contour.

6. The nail printing device of claim 4, wherein the second nail contour recognizing section changes a detection threshold for recognizing the second nail contour from the second nail image so that the second nail contour has a shape close to the adjusted nail contour, sets the detection threshold, and sets the nail contour, which is recognized from the second nail image by using the set detection threshold, as the adjusted recognized nail contour.

7. The nail printing device of claim 1, further comprising an operation section which receives an input to specify the first specified portion with respect to the first nail contour, wherein the first nail contour recognizing section detects a plurality of first candidate nail contours different from the first nail contour, the operation section, in accordance with the input to specify the first specified portion, specifies two different points on the first nail contour and a shape of an adjustment line connecting the two points to each other, and the recognition result adjusting section selects a nail contour which is nearest to the adjustment line with respect to the first nail contour, from among the plurality of first candidate nail contours, as a first adjusted nail contour, and adjusts the first nail contour by using the first adjusted nail contour.

8. The nail printing device of claim 1, further comprising an operation section which receives an input to specify the first specified portion with respect to the first nail contour, wherein the operation section receives an input for specifies, as the adjustment portion, two different points on the first nail contour and a shape of an adjustment line connecting the two points to each other, and the recognition result adjusting section adjusts the first nail contour after correcting the adjustment line so as to reduce an unnatural/human-induced unevenness in the adjustment line, or without correction of the adjustment line.

9. A print control method for a nail printing device including a storage section, a display section, and a print head, the method comprising the steps of:

recognizing, as a first nail contour, a nail contour from a first nail image obtained by photographing a nail of a specific finger/toe and storing data of the first nail contour in the storing section;

displaying the first nail contour in the display section on the basis of the data of the first nail contour stored in the storage section;

performing an adjustment of a shape of a first specified portion of the first nail contour without adjusting another part of the first nail contour than the first specified portion on the basis of a nail contour adjusting process performed with respect to the first specified portion, the first specified portion being specified along a part of the first nail contour displayed on the display section, obtaining an adjusted nail contour and storing: information on the adjustment performed to the first specified portion in the storage section;

recognizing, as a second nail contour, a nail contour from a second nail image obtained by photographing the nail of the specific finger/toe after the adjustment of the shape of the first specified portion of the first nail contour is performed;

obtaining an adjusted recognized nail contour by reflecting in the second nail contour the information on the adjustment performed to the first specified portion of the first nail contour, the information being read out from the storage section and performing an adjustment of a shape of a second specified portion specified on a part of the second nail contour corresponding to the first specified portion without adjusting another part of the second nail contour than the second specified portion; and controlling the print head to perform printing in a region of the adjusted recognized nail contour.

10. The print control method for the nail printing device of claim 9, wherein the nail printing device include a finger/toe insertion section into which a finger/toe is to be inserted, wherein performing the adjustment of the shape of the first specified portion of the first nail contour is executed in the state that the specific finger/toe is not inserted into the finger/toe insertion section.

11. The print control method for the nail printing device of claim 9, wherein the nail printing device include a finger/toe insertion section into which a finger/toe is to be inserted and a photographing section to photograph the nail of the finger/toe inserted into the finger/toe insertion section, wherein the displaying step includes displaying the first nail image and the first nail contour on the basis of the image being photographed by the photographing section when the specific finger/toe is inserted into the finger/toe insertion section, and displaying the first nail image and the first nail contour on the basis of the data stored in the storage section when the specific finger/toe is not inserted into the finger/toe insertion section, in the display section.

12. The print control method for the nail printing device of claim 9, wherein the recognizing step of the first nail contour includes detecting a plurality of first candidate nail contours different from the first nail contour, and the obtaining step of the adjusted nail contour includes specifying at least two different points on the first nail contour as first border branch points, the first specified portion being located between two first border branching points, selecting a nail contour which is nearest to a line obtained by smoothly connecting the two first border branching points with respect to the first nail contour, from among the plurality of first candidate nail contours, as a first adjusted nail contour, and adjusting the first nail contour by using the first border branch points and the first adjusted nail contour.

13. The print control method for the nail printing device of claim 12, wherein the recognizing step of the second nail contour includes detecting a plurality of second candidate nail contours different from the second nail contour, and the obtaining step of the adjusted recognized nail contour includes: detecting points on the second nail contour, the points corresponding to the first border branch points, as second border branch points; detecting a nail contour corresponding to the first adjusted nail contour from among the plurality of second candidate nail contours as a second adjusted nail contour; and adjusting the second nail contour by using the second border branch points and the second adjusted nail contour.

14. The print control method for the nail printing device of claim 12, wherein the obtaining step of the adjusted recognized nail contour includes: changing a detection threshold for recognizing the second nail contour from the second nail image so that the second nail contour has a shape close to the adjusted nail contour; setting the detection threshold; and setting the nail contour, which is recognized from the second nail image by using the set detection threshold, as the adjusted recognized nail contour.

15. The print control method for the nail printing device of claim 9, wherein the recognizing step of the first nail contour includes detecting a plurality of first candidate nail contours different from the first nail contour, the obtaining step of the adjusted nail contour includes specifying, as the first specified portion, two different points on the first nail contour and a shape of an adjustment line connecting the two points to each other, and selecting a nail contour which is nearest to the adjustment line with respect to the first nail contour, from among the plurality of first candidate nail contours, as a first adjusted nail contour, and adjusting the first nail contour by using the first adjusted nail contour.

16. The print control method for the nail printing device of claim 9, wherein the obtaining step of the adjusted nail contour step includes: specifying, as the first specified portion, two different points on the first nail contour and a shape of an adjustment line connecting the two points to each other; and obtaining the adjusted nail contour by adjusting the first nail contour after correcting the adjustment line so as to reduce an unnatural/human-induced unevenness in the adjustment line, or without correction of the adjustment line.

17. A non-transitory computer readable medium storing a print control program for causing a computer of a nail printing device including a storage section, a display section, and a print head to execute the steps of:

recognizing, as a first nail contour, a nail contour from a first nail image obtained by photographing a nail of a specific finger/toe and storing data of the first nail contour in the storing section;

displaying the first nail contour in the display section on the basis of the data of the first nail contour stored in the storage section;

performing an adjustment of a shape of a first specified portion of the first nail contour without adjusting another part of the first nail contour than the first specified portion on the basis of a nail contour adjusting process performed with respect to the first specified portion, the first specified portion being specified along a part of the first nail contour displayed on the display section, obtaining an adjusted nail contour and storing information on the adjustment performed to the first specified portion in the storage section;

recognizing, as a second nail contour, a nail contour from a second nail image obtained by photographing the nail of the specific finger/toe after the adjustment of the shape of the first specified portion of the first nail contour is performed;

obtaining an adjusted recognized nail contour by reflecting in the second nail contour the information on the adjustment performed to the first specified portion of the first nail contour, the information being read out from the storage section and performing an adjustment of a shape of a second specified portion specified on a part of the second nail contour corresponding to the first specified portion without adjusting another part of the second nail contour than the second specified portion; and controlling the print head to perform printing in a region of the adjusted recognized nail contour.

* * * * *